US011053615B2

(12) United States Patent
Stewart et al.

(10) Patent No.: US 11,053,615 B2
(45) Date of Patent: Jul. 6, 2021

(54) METAL ALLOY KNIT FABRIC FOR HIGH TEMPERATURE INSULATING MATERIALS

(71) Applicant: THE BOEING COMPANY, Chicago, IL (US)

(72) Inventors: Tiffany A. Stewart, Sherman Oaks, CA (US); Amoret M. Chappell, St. Charles, MO (US); Christopher P. Henry, Thousand Oaks, CA (US)

(73) Assignee: THE BOEING COMPANY, Chicago, IL (US)

( * ) Notice: Subject to any disclaimer, the term of this patent is extended or adjusted under 35 U.S.C. 154(b) by 0 days.

(21) Appl. No.: 16/441,353

(22) Filed: Jun. 14, 2019

(65) Prior Publication Data

US 2019/0330772 A1 Oct. 31, 2019

Related U.S. Application Data

(63) Continuation of application No. 15/012,509, filed on Feb. 1, 2016, now Pat. No. 10,337,130.

(51) Int. Cl.

| | |
|---|---|
| ***D04B 21/12*** | (2006.01) |
| ***C22F 1/10*** | (2006.01) |
| ***D04B 1/22*** | (2006.01) |

(52) U.S. Cl.

CPC ..... *D04B 21/12* (2013.01); *C22F 1/10* (2013.01); *D04B 1/225* (2013.01); *D10B 2505/06* (2013.01)

(58) Field of Classification Search

CPC ..... D04B 21/12; D04B 1/225; C22F 1/10; D10B 2505/06

See application file for complete search history.

(56) References Cited

U.S. PATENT DOCUMENTS

| | | | |
|---|---|---|---|
| 1,976,885 | A | 10/1934 | Levin |
| 2,112,769 | A | 3/1938 | James |

(Continued)

FOREIGN PATENT DOCUMENTS

| | | | |
|---|---|---|---|
| CN | 101087893 | A | 12/2007 |
| CN | 201092600 | Y | 7/2008 |

(Continued)

OTHER PUBLICATIONS

Canadian Intellectual Property Office Requisition for Application No. 2,953,839 dated Sep. 19, 2019.

(Continued)

*Primary Examiner* — Cephia D Toomer

(74) *Attorney, Agent, or Firm* — Patterson + Sheridan, LLP

(57) ABSTRACT

Metal alloy knit fabrics, thermal protective members formed therefrom and their methods of construction are disclosed. This unique capability to knit high temperature metal alloy wire that is drapable allows for the creation of near net-shape preforms at production level speed. Additionally, ceramic insulation can also be integrated concurrently to provide increased thermal protection. The metal alloy knit fabrics described herein overcome the limitations of current welded stainless steel mesh seal coverings by providing coverings that withstand higher operational temperatures than stainless steel, are wear and snag resistant, can be a separate seal layer or as a portion of an integrated seal construction, can accommodate tight curvature changes to achieve complex shapes without wrinkling or buckling, and can be joined in the knitting process, sewed or mechanically fastened, without the need for welding.

21 Claims, 12 Drawing Sheets

(56) References Cited

U.S. PATENT DOCUMENTS

| | | | |
|---|---|---|---|
| 2,445,231 | A | 7/1948 | McDermott |
| 3,020,185 | A | 2/1962 | Moffitt, Jr. et al. |
| 3,964,277 | A | 6/1976 | Miles |
| 3,999,930 | A | 12/1976 | Telbizoff |
| 4,036,037 | A | 7/1977 | Huckfeldt |
| 4,244,197 | A | 1/1981 | Althammer |
| 4,375,779 | A | 3/1983 | Fischer |
| 4,441,726 | A | 4/1984 | Uhl |
| 4,468,043 | A | 8/1984 | Brazel |
| 4,470,251 | A | 9/1984 | Bettcher |
| 5,014,917 | A | 5/1991 | Sirocky et al. |
| 5,070,540 | A | 12/1991 | Bettcher et al. |
| 5,266,293 | A | 11/1993 | Fairey et al. |
| 5,332,239 | A | 7/1994 | Steinetz et al. |
| 5,632,137 | A | 5/1997 | Kolmes et al. |
| 5,910,094 | A | 6/1999 | Kraft et al. |
| 5,965,223 | A | 10/1999 | Andrews et al. |
| 6,015,618 | A | 1/2000 | Orima |
| 6,089,051 | A | 7/2000 | Gorywoda et al. |
| 6,151,922 | A | 11/2000 | Shimasaki |
| 6,363,703 | B1 | 4/2002 | Kolmes |
| 6,381,940 | B1 | 5/2002 | Kolmes et al. |
| 6,699,540 | B1 | 3/2004 | Tsukamoto |
| 6,800,367 | B2 | 10/2004 | Hanyon et al. |
| 6,966,590 | B1 | 11/2005 | Ksiezopolki et al. |
| 7,028,740 | B2 | 4/2006 | Clarady et al. |
| 7,153,864 | B2 | 12/2006 | Bhatt et al. |
| 7,219,899 | B2 | 5/2007 | Kesseg |
| 7,341,613 | B2 | 3/2008 | Kirsch |
| 7,419,202 | B1 | 9/2008 | Hanser et al. |
| 7,637,549 | B2 | 12/2009 | Hess |
| 7,658,087 | B1 | 2/2010 | McMurray et al. |
| 7,823,420 | B2 | 11/2010 | Andrieu et al. |
| 8,070,918 | B2 | 12/2011 | Suzuki et al. |
| 8,327,905 | B2 | 12/2012 | McDonald et al. |
| 8,366,168 | B1 | 2/2013 | Ksiezopolski et al. |
| 8,434,333 | B2 | 5/2013 | Zhang et al. |
| 8,505,339 | B2 | 8/2013 | Malloy et al. |
| 8,733,762 | B2 | 5/2014 | Barnes |
| 9,028,937 | B2 | 5/2015 | Harris et al. |
| 9,062,396 | B2 | 6/2015 | Putta et al. |
| 9,169,930 | B2 | 10/2015 | Panchal et al. |
| 9,745,204 | B2 | 8/2017 | Konishi et al. |
| 10,184,194 | B2 | 1/2019 | Henry et al. |
| 2002/0079655 | A1 | 6/2002 | Aksit et al. |
| 2002/0129751 | A1 | 9/2002 | Groen et al. |
| 2003/0089971 | A1 | 5/2003 | Akers et al. |
| 2004/0091705 | A1 | 5/2004 | Hanyon et al. |
| 2006/0013990 | A1 | 1/2006 | Brentrup et al. |
| 2007/0131302 | A1 | 6/2007 | Relats et al. |
| 2007/0148399 | A1 | 6/2007 | Chen |
| 2008/0128054 | A1 | 6/2008 | Johns |
| 2009/0050226 | A1 | 2/2009 | Mirmand et al. |
| 2009/0173108 | A1 | 7/2009 | Okamoto |
| 2011/0224703 | A1 | 9/2011 | Mortarino |
| 2012/0234051 | A1 | 9/2012 | Huffa |
| 2013/0274858 | A1 | 10/2013 | Bar et al. |
| 2014/0237861 | A1 | 8/2014 | Podhajny |
| 2015/0075228 | A1 | 3/2015 | De Keyzer et al. |
| 2015/0351469 | A1 | 12/2015 | McGovern |
| 2016/0024693 | A1 | 1/2016 | Henry et al. |
| 2016/0369436 | A1 | 12/2016 | Stewart et al. |
| 2017/0218542 | A1 | 8/2017 | Stewart et al. |
| 2019/0145027 | A1 | 5/2019 | Henry et al. |

FOREIGN PATENT DOCUMENTS

| | | | | |
|---|---|---|---|---|
| CN | 201826113 | U | 5/2011 | |
| DE | 3622781 | A1 | 1/1988 | |
| DE | 102012214328 | A1 | 2/2014 | |
| EP | 0384613 | A1 | 8/1990 | |
| EP | 0794367 | A2 | 9/1997 | |
| EP | 1274959 | A1 | 1/2003 | |
| EP | 2370805 | A1 | 10/2011 | |
| EP | 3106556 | A1 | 12/2016 | |
| GB | 2271396 | A * | 4/1994 | ..... F16J 15/22 |
| WO | 9401373 | A1 | 1/1994 | |
| WO | 01079756 | A1 | 10/2001 | |
| WO | 02062466 | A2 | 8/2002 | |
| WO | 02075216 | A1 | 9/2002 | |
| WO | 2006051338 | A2 | 5/2006 | |
| WO | 2007133372 | A2 | 11/2007 | |

OTHER PUBLICATIONS

Chinese Office Action for Application No. 20170055393.X dated Jun. 30, 2020.

Chinese Office Action for Application No. 201710055393.X dated Nov. 12, 2019.

Extended European Search Report for European Application No. 16169436.9 dated Oct. 19, 2016.

Extended Search Report for Application No. 17151390.6-1710 dated Jun. 28, 2017.

Canadian Office Action for Application No. 2,926,393 dated Oct. 25, 2018.

Extended European Search Report for Application No. 172101347.1018 dated Jun. 11, 2018.

Japanese Office Action for Application No. 2017-009667 dated Feb. 11, 2020.

Chinese National Intellectual Property Administration Search Report for Application No. 201710055393X dated Dec. 15, 2020.

Chinese Office Action for Application No. 201710055393.X dated Nov. 16, 2020.

Chinese Office Action for Application No. 201710055393.X dated Feb. 24, 2021.

* cited by examiner

METAL ALLOY KNIT FABRIC FOR HIGH TEMPERATURE INSULATING MATERIALS

RELATED APPLICATION

This application is a continuation of co-pending U.S. patent application Ser. No. 15/012,509, filed Feb. 1, 2016, which is herein incorporated by reference in its entirety.

FIELD

The implementations described herein generally relate to knit fabrics and more particularly to metal alloy knit fabrics for high temperature applications, components formed therefrom and to their methods of construction.

BACKGROUND

In many high-temperature applications, such as aircraft structures, thermal sealing members are often utilized between opposing faces or parts. Typically, the thermal sealing member provides a thermal barrier that will withstand particular conditions, for example, an exposure to temperatures in excess of 1,000 degrees Celsius for a time in excess of 15 minutes. These opposing parts are subject to operational loaded vibration as well as repeated opening and closing during operation and maintenance procedures. As such, these thermal sealing members are subject to a high degree of wear and potential for damage.

Current techniques for manufacturing thermal sealing members include the use of multilayer materials including, for example, stainless steel spring tube, multiple layers of woven ceramic fabric, and a woven outer stainless steel mesh integrated by hand. Beyond the fabrication challenges, the stiffness of the woven outer stainless steel mesh is relatively low, which can lead to wrinkling, deformation, and subsequently degraded performance. Further, splicing and welding of the woven outer stainless steel mesh is often required to form curved or complex shapes. This splicing and welding process is extremely time consuming and laborious. In addition, these welds create wear points on the seal itself at the mating surface. In applications where the mating surface is aluminum, the woven outer stainless steel mesh can cause galvanic corrosion.

The woven outer stainless steel mesh is also limited to an operational temperature below 800 degrees Fahrenheit (approximately 427 degrees Celsius). If temperatures exceed 800 degrees Fahrenheit, the woven outer stainless steel mesh suffers from embrittlement and begins to fail exposing the underlying layers of woven ceramic fabric to the wear surface. Failure of the woven ceramic fabric exposes the underlying stainless steel spring tube to high temperatures, causing plastic deformation, compression set, and ultimate failure as a thermal barrier.

Therefore, there is a need for improved higher temperature capable thermal sealing members that permit higher operational temperatures while minimizing compression set under thermal loads and low cost methods of manufacturing the same.

SUMMARY

The implementations described herein generally relate to knit fabrics and more particularly to metal alloy knit fabrics for high temperature applications, components (e.g., thermal sealing members) formed therefrom and to their methods of construction. According to one implementation, a single-layer metal alloy knit fabric formed by knit loops of a metal alloy wire, wherein the single-layer metal alloy knit fabric can withstand temperatures greater than or equal to 1,000 degrees Fahrenheit (approximately 538 degrees Celsius) is provided.

In some implementations, a method for machine knitting a single-layer metal alloy knit fabric formed by knit loops of a metal alloy wire is provided. The method comprises feeding the metal alloy wire through a single material feeder of a knitting machine and knitting the metal alloy wire to form the single-layer metal alloy knit fabric, wherein the single-layer metal alloy knit fabric can withstand temperatures greater than or equal to 1,000 degrees Fahrenheit (approximately 538 degrees Celsius).

In some implementations, the knitting machine may be a flat knitting machine. In some implementations, the knitting machine may have needles spaced apart by a needle gauge interval of between 7 to 18 gauge (needles/inch). In some implementations, the metal alloy wire may be in a soft-tempered state while knitting the metal alloy wire. In some implementations, the single-layer metal alloy knit fabric may be heat treated to harden the soft-tempered metal alloy wire. In some implementations, insulation material may be added to a face of the single-layer metal alloy knit fabric. In some implementations, the knitting may be performed using either a flat-knitting process or a tubular-knitting process. In some implementations, the single-layer metal alloy knit fabric is knit as a tubular structure. In some implementations, the knitting may be performed using a weft-knitting process or a warp-knitting process.

In some implementations, a thermal sealing member is provided. The thermal sealing member comprises a wrap member constructed of a ceramic-based fiber material and an outer wrap member constructed of at least one single-layer metal alloy knit fabric formed by knit loops of a metal alloy wire, wherein the single-layer metal alloy knit fabric can withstand temperatures greater than or equal to 1,000 degrees Fahrenheit (approximately 538 degrees Celsius).

In some implementations, the thermal sealing member further comprises a core member, wherein the wrap member covers the core member. In some implementations, the thermal sealing member further comprises a core member constructed of a resilient material having spring-like properties and an insulating material disposed within the core member. In some implementations, the core member is constructed of a material selected from the group consisting of stainless steel, ceramic material, a nickel-chromium superalloy, and combinations thereof.

In some implementations, the ceramic-based fiber material has an alumina-boria-silica composition. In some implementations, the ceramic-based fiber material is a single-layer ceramic-based knit fabric comprising a continuous ceramic strand, a continuous load-relieving process aid strand. The continuous ceramic strand serves the continuous load-relieving process aid strand and a first metal alloy wire. The continuous ceramic strand, the continuous load-relieving process aid strand, and the first metal alloy wire are knit to form the single-layer ceramic-based knit fabric.

In some implementations, the thermal sealing member further comprises insulation material positioned in an interior of the thermal sealing member. The insulation material may be stitched to the single-layer ceramic-based knit fabric.

In some implementations, the thermal sealing member is selected from an M-shaped double-blade bulb seal, an omega-shaped bulb seal, a dual-bulb elliptical seal, and a P-shaped bulb seal.

In some implementations, the thermal sealing member is made from shaping the single-layer ceramic-based knit fabric into an M-shaped double-blade bulb seal, an omega-shaped bulb seal, a dual-bulb elliptical seal, or a P-shaped bulb seal.

In some implementations, the single-layer metal alloy knit fabric is formed using a weft-knitting process or a warp-knitting process. In some implementations, the single-layer metal alloy knit fabric has between 3 and 10 wales per centimeter and between 3 and 10 courses per centimeter. In some implementations, the single-layer metal alloy knit fabric is constructed using a flat knitting technique.

In some implementations, the metal alloy wire is constructed of a nickel-chromium superalloy. In some implementations, the metal alloy wire is heat treat hardenable. In some implementations, the metal alloy wire has a Rockwell C Hardness of up to 47 RC. In some implementations, the metal alloy wire has a diameter from about 0.003 inches (0.0762 millimeters) to about 0.007 inches (0.1778 millimeters).

In some implementations, the single-layer metal alloy knit fabric is formed as a tubular structure using a tubular knitting technique. In some implementations, insulation material is inserted into the tubular structure while the tubular structure is being formed.

In some implementations, the single-layer metal alloy knit fabric further comprises insulation material on one face of the fabric. In some implementations, the metal alloy wire is knit in a soft-tempered state. In some implementations, the soft-tempered metal alloy wire is heat hardened after a final shape of the knit fabric is achieved.

The features, functions, and advantages that have been discussed can be achieved independently in various implementations or may be combined in yet other implementations, further details of which can be seen with reference to the following description and drawings.

BRIEF DESCRIPTION OF ILLUSTRATIONS

So that the manner in which the above-recited features of the present disclosure can be understood in detail, a more particular description of the disclosure briefly summarized above may be had by reference to implementations, some of which are illustrated in the appended drawings. It is to be noted, however, that the appended drawings illustrate only typical implementations of this disclosure and are therefore not to be considered limiting of its scope, for the disclosure may admit to other equally effective implementations.

To facilitate understanding, identical reference numerals have been used, wherever possible, to designate identical elements that are common to the figures. Additionally, elements of one implementation may be advantageously adapted for utilization in other implementations described herein.

DETAILED DESCRIPTION

Figure 1:
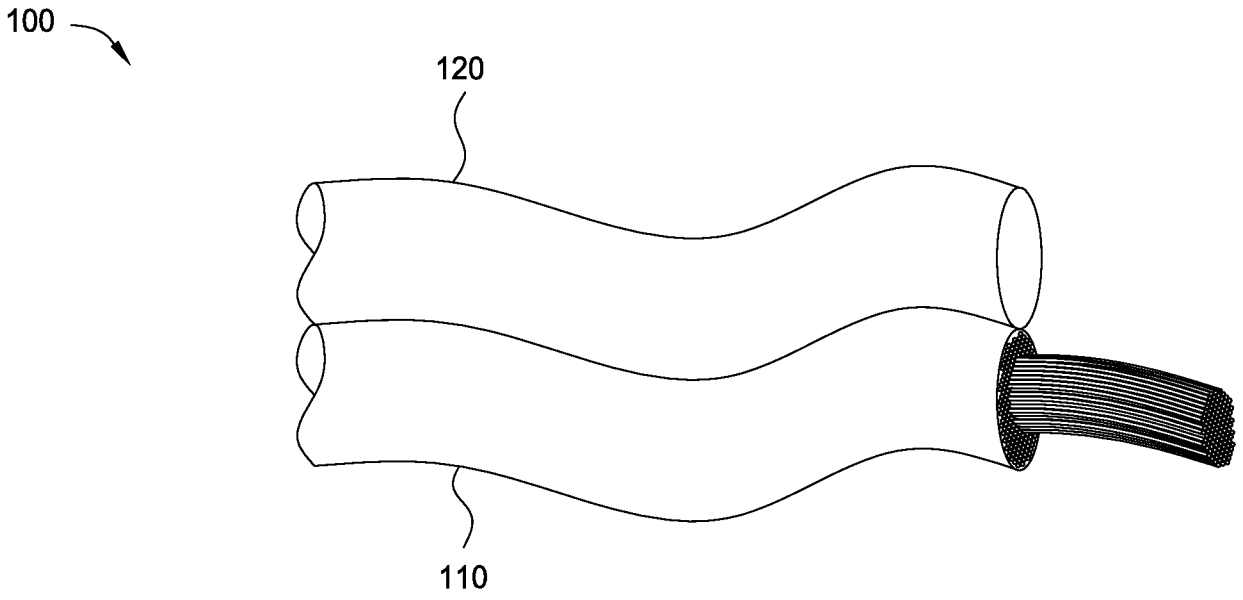
FIG. 1 is an enlarged partial perspective view of a multicomponent stranded yarn including a continuous ceramic strand and a continuous load-relieving process aid strand prior to processing according to implementations described herein.

The following disclosure describes knit fabrics and more particularly metal alloy knit fabrics for high temperature applications, components (e.g., thermal sealing members) formed therefrom and to their methods of construction. Certain details are set forth in the following description and in FIGS. 1-14 to provide a thorough understanding of various implementations of the disclosure. Other details describing well-known structures and systems often associated with knit fabric types and architectures and forming knit fabrics are not set forth in the following disclosure to avoid unnecessarily obscuring the description of the various implementations.

Many of the details, dimensions, angles and other features shown in the Figures are merely illustrative of particular implementations. Accordingly, other implementations can have other details, materials, components, dimensions, angles and features without departing from the spirit or scope of the present disclosure. In addition, further implementations of the disclosure can be practiced without several of the details described below.

Prior to the implementations described herein, it was not feasible to produce products having high durability, complex geometries or near net-shape components by knitting metal alloy materials into a single-layer at production level speeds. Current techniques for producing high temperature seals include multilayer solutions having stainless steel spring tube, multiple layers of woven ceramic and an outer woven stainless steel mesh that must be integrated by hand. Beyond the fabrication challenges, the outer woven stainless steel mesh stiffness is relatively low, which can lead to wrinkling, deformations, and subsequently to degraded performance. Further, splicing and welding of the outer woven stainless steel mesh is required to form curved or complex shapes. This welding process is extremely time consuming and laborious. In addition, these welds create wear points on the seal itself at the mating surface. In applications where the mating surface is aluminum, the outer woven stainless steel mesh can cause galvanic corrosion.

The woven outer stainless steel mesh is also limited to an operational temperature of 800 degrees Fahrenheit (approximately 427 degrees Celsius). If temperatures exceed 800 degrees Fahrenheit, the woven outer stainless steel mesh will suffer embrittlement and begin to fail exposing the layers of woven ceramic fabric to the wear surface. Failure of the woven ceramic fabric exposes the stainless steel spring tube to high temperatures, causing plastic deformation, compression set, and ultimate failure as a thermal barrier.

Thus, most fabrication techniques including woven outer stainless steel mesh fail to address the fundamental issues of producing durable, drapable, efficient, and low cost thermal barrier seals that permit higher operation temperatures while minimizing compression set under thermal loads. The unique capability to knit high temperature metal alloy fabrics creates a durable wear resistant layer capable of forming complex near net-shape preforms at production-level speed with improved durability, drapability, and compression set at thermal loads. The knit metal alloy fabrics have the ability to form into more complex shapes than currently available woven mesh materials due to the ability of localized knit stitch geometry changes (e.g., loop reshaping). Therefore, a drapable metal alloy knit durability layer potentially reduces the need for splicing and welding operations, as in the current state of the art, reducing labor costs. The metal alloy knit durability layer can either be knit to the same shape as underlying knit layers, and formed simultaneously into the seal shape or can be knit into a tubular shape such that a formed seal can be placed inside the tubular metal alloy knit shape.

The implementations described herein overcome the limitations of current welded stainless steel mesh seal coverings by providing coverings that withstand higher operational temperatures than stainless steel, are wear and snag resistant, can be a separate seal layer or as a portion of an integrated seal construction, can accommodate tight curvature changes to achieve complex shapes without wrinkling or buckling, and can be joined in the knitting process, sewed or mechanically fastened, without the need for welding.

The metal alloy knit fabrics described herein may be knit with commercially available flat knitting machines. The fine metal alloy wires described herein can be knit and formed into near net shaped parts in a soft-tempered state, then heat treated such that the metal alloy wire is fully hardened, resulting in a durable, high temperature capable metal alloy knit layer.

Most current state of the art knitting techniques do not envision knitting hard high temperature capable metallic materials due to challenges in bending these materials and the wear of these materials during the knitting action on machine needles especially in finer gauge machines. In some implementations described herein, soft-tempered metal alloy wire materials that are softer than the knitting needles are used during the knitting process and then hardened to the desired application hardness (e.g., up to RC 47). In some implementations, the diameter of the metal alloy wire material is selected relative to the needle gauge in the knitting machine to provide easy bending for stitch formation and prevent needle breakage (helping ensure reliable, high utilization production). In some implementations, the metal alloy wire has a diameter ranging from 0.003 inches to 0.007 inches. In some implementations, the area range (i.e., the ratio of the diameter of the needle to the diameter of the wire being knitted) between needle and the metal alloy wire being knit is between 40:1 and 5:1 for most knitting machines in the 7 to 18 gauge (needles/inch) range and knit metal alloys of interest.

Further, there is a long felt need for shaped outer metallic coverings that provide durability and abrasion resistance that is satisfied by the shaped metallic knit fabrics described herein. The current state of the art involves welding mesh materials together which is a time intensive process using a skilled worker.

This disclosure describes metal alloy knit fabrics that may be produced using a commercially available knitting machine. The metal alloy knit fabrics described herein enable high temperature (e.g., greater than or equal to 1,000 degrees Fahrenheit (approximately 538 degrees Celsius)) durability of insulating materials over current state of the art knits and woven meshes. In some implementations, fine metal alloy knit mesh is constructed using a flat knitting machine with wire diameters ranging from 0.003 inches to 0.007 inches, and then heat hardened after the fabric is knit and formed to the final desired shape. Heat hardening increases the hardness, or durability of the metal alloy knit fabric at elevated temperatures.

The metal alloy knit fabric can be constructed on the flat knitting machine in either a flat format or tubular format, allowing versatility of achievable geometries. Further, insulating materials can then be applied to one side of the fabric or to the inside of the tube. The knit metal alloy fabric can be designed such that geometric features can be incorporated, such as holes, flanges, or overlapping flaps for attachments and insulation enclosure, permitting shaping of metal fabrics without cutting or sewing. Additionally, the metal alloy knit fabric can embody a construction such as a "T" or "Y" configuration where one fabric can be divided into two fabrics. Various cross-sections can also be fabricated with this process, such as "P"-shapes, "omega"-shapes, dual-bulb, or an "M"-shape. Shaping of the metal alloy knit layer potentially reduces the need for additional processing steps such as splicing and welding, as is commonly used in current state of the art materials. Discrete wear points created by splicing and welding used for current state of the art materials can lead to ultimate failure of the durability layer.

The implementations described herein are potentially useful across a broad range of products, including many industrial products and aerospace products (subsonic, supersonic and space), which would significantly benefit from lighter-weight, low cost, and higher temperature capable shaped components. These components include but are not limited to a variety of soft goods such as, for example, thermally resistant seals, gaskets, expansion joints, blankets, wiring insulation, tubing/ductwork, piping sleeves, firewalls, insulation for thrust reversers, engine struts and composite fan cowls. These components also include but are not limited to hard goods such as exhaust and engine coverings, liners, shields and tiles.

The metal alloy knit fabrics described herein can be knit into components having complex geometries or near net-shape components and fabrics containing spatially differentiated zones, both simple and complex, directly off the machine through conventional bind off and other apparel knitting techniques. Exemplary near net-shapes include simple box-shaped components, complex curvature variable diameter tubular shapes, and geometric tubular shapes.

The term "filament" as used herein refers to a fiber that comes in continuous or near continuous length. The term "filament" is meant to include monofilaments and/or multi-filament, with specific reference being given to the type of filament, as necessary.

The term "flexible" as used herein means having a sufficient pliability to withstand small radius bends, or small loop formation without fracturing, as exemplified by not having the ability to be used in stitch bonding or knitting machines without substantial breakage.

The term "heat fugitive" as used herein means volatizes, burns or decomposes upon heating.

The term "knit direction" as used herein is vertical during warp-knitting and horizontal during weft-knitting.

The term "strand" as used herein means a plurality of aligned, aggregated fibers or filaments.

The term "yarn" as used herein refers to a continuous strand or a plurality of strands spun from a group of natural or synthetic fibers, filaments or other materials, which can be twisted, untwisted or laid together.

The term "wire" as used herein refers to a filament of material of the single elongated continuous article from which the wire is produced. The material may be metal, metal alloys, composite materials, or combinations thereof.

Referring in more detail to the drawings, FIG. 1 is an enlarged partial perspective view of a multicomponent stranded yarn 100 including a continuous ceramic strand 110 and a continuous load-relieving process aid strand 120 prior to processing according to implementations described herein. The continuous load-relieving process aid strand 120 is typically under tension during the knitting process while reducing the amount of tension that the continuous ceramic strand is subjected to during the knitting process. As depicted in FIG. 1, the multicomponent stranded yarn 100 is a bi-component stranded yarn.

The continuous ceramic strand 110 may be a high temperature resistant ceramic strand. The continuous ceramic strand 110 is typically resistant to temperatures greater than 500 degrees Celsius (e.g., greater than 1,200 degrees Celsius). The continuous ceramic strand 110 typically comprises multi-filament inorganic fibers. The continuous ceramic strand 110 may comprise individual ceramic filaments whose diameter is about 15 micrometers or less (e.g., 12 micrometers or less; a range from about 1 micron to about 12 micrometers) and with the yarn having a denier in the range of about 50 to 2,400 (e.g., a range from about 200 to about 1,800; a range from about 400 to about 1,000). The continuous ceramic strand 110 can be sufficiently brittle but not break in a small radius bend of less than 0.07 inches (0.18 cm). In some implementations, a continuous carbon-fiber strand may be used in place of the continuous ceramic strand 110.

Exemplary inorganic fibers include inorganic fibers such as fused silica fiber (e.g., Astroquartz® continuous fused silica fibers) or non-vitreous fibers such as graphite fiber, silicon carbide fiber (e.g., Nicalon™ ceramic fiber available from Nippon Carbon Co., Ltd. of Japan) or fibers of ceramic metal oxide(s) (which can be combined with non-metal oxides, e.g., $SiO_2$) such as thoria-silica-metal (III) oxide fibers, zirconia-silica fibers, alumina-silica fibers, alumina-chromia-metal (IV) oxide fiber, titania fibers, and alumina-boria-silica fibers (e.g., 3M™ Nextel™ 312 continuous ceramic oxide fibers). These inorganic fibers may be used for high temperature applications. In implementations where the continuous ceramic strand 110 comprises alumina-boria-silica yarns, the alumina-boria-silica may comprise individual ceramic filaments whose diameter is about 8 micrometers or less with the yarn having a denier in the range of about 200 to 1,200.

The continuous load-relieving process aid strand 120 may be a monofilament or multi-filament strand. The continuous load-relieving process aid strand 120 may comprise organic (e.g., polymeric), inorganic materials (e.g., metal or metal alloy) or combinations thereof. In some implementations, the continuous load-relieving process aid strand 120 is flexible. In some implementations, the continuous load-relieving process aid strand 120 has a high tensile strength and a high modulus of elasticity. In implementations where the continuous load-relieving process aid strand 120 is a monofilament, the continuous load-relieving process aid strand 120 may have a diameter from about 100 micrometers to about 625 micrometers (e.g., from about 150 micrometers to about 250 micrometers; from about 175 micrometers to about 225 micrometers). In implementations where the continuous load-relieving process aid strand 120 is a multifilament, the individual filaments of the multifilament may each have a diameter from about 10 micrometers to about 50 micrometers (e.g., from about 20 micrometers to about 40 micrometers).

Depending on the application, the continuous load-relieving process aid strand 120, whether multifilament or monofilament, can be formed from, by way of example and without limitation, from polyester, polyamide (e.g., Nylon 6,6), polyvinyl acetate, polyvinyl alcohol, polypropylene, polyethylene, acrylic, cotton, rayon, and fire retardant (FR) versions of all the aforementioned materials when extremely high temperature ratings are not required. If higher temperature ratings are desired along with FR capabilities, then the continuous load-relieving process aid strand 120 could be constructed from, by way of example and without limitation, materials including meta-Aramid fibers (sold under names Nomex®, Conex®, for example), para-Aramid (sold under the tradenames Kevlar®, Twaron®, for example), polyetherimide (PEI) (sold under the tradename Ultem®, for example), polyphenylene sulfide (PPS), liquid crystal thermoset (LCT) resins, polytetrafluoroethylene (PTFE), and polyether ether ketone (PEEK). When even higher temperature ratings are desired along with FR capabilities, the continuous load-relieving process aid strand 120 can include mineral yarns such as fiberglass, basalt, silica and ceramic, for example. Aromatic polyamide yarns and polyester yarns are illustrative yarns that can be used as the continuous load-relieving process aid strand 120.

In some implementations, the continuous load-relieving process aid strand 120, when made of organic fibers, may be heat fugitive, i.e., the organic fibers are volatized or burned away when the knit article is exposed to a high temperatures (e.g., 300 degrees Celsius or higher; 500 degrees Celsius or higher). In some implementations, the continuous load-relieving process aid strand 120, when made of organic fibers, may be chemical fugitive, i.e., the organic fibers are dissolved or decomposed when the knit article is exposed to a chemical treatment.

In some implementations, the continuous load-relieving process aid strand 120 is a metal or metal alloy. In some implementations for corrosion resistant applications, the continuous load-relieving process aid strand 120 may comprise continuous strands of nickel-chromium based alloys, such as alloys comprising more than 12% by weight of chromium and more than 40% by weight of nickel (e.g., Inconel® alloys, Inconel® alloy 718), nickel-chromium-molybdenum based alloys, such as alloys comprising at least 10% by weight of molybdenum and more than 20% by weight of chromium (e.g., Hastelloy), aluminum, stainless steel, such as a low carbon stainless steel, for example, SS316L, which has high corrosion resistance properties. Other conductive continuous strands of metal wire may be used, such as, for example, copper, tin or nickel-plated copper, and other metal alloys. These conductive continuous strands may be used in conductive applications. In implementations where the continuous load-relieving process aid strand 120 is a multifilament, the individual filaments of the multifilament may each have a diameter from about 50 micrometers to about 300 micrometers (e.g., from about 100 micrometers to about 200 micrometers).

The continuous load-relieving process aid strand 120 and the continuous ceramic strand 110 may both be drawn into a knitting system through a single material feeder together or "plated" in the knitting system through two material feeders to create the desired knit fabric with the continuous load-relieving process aid strand 120 substantially exposed on one face of the fabric and the continuous ceramic strand 110 substantially exposed on the opposing face of the fabric.

Figure 2:
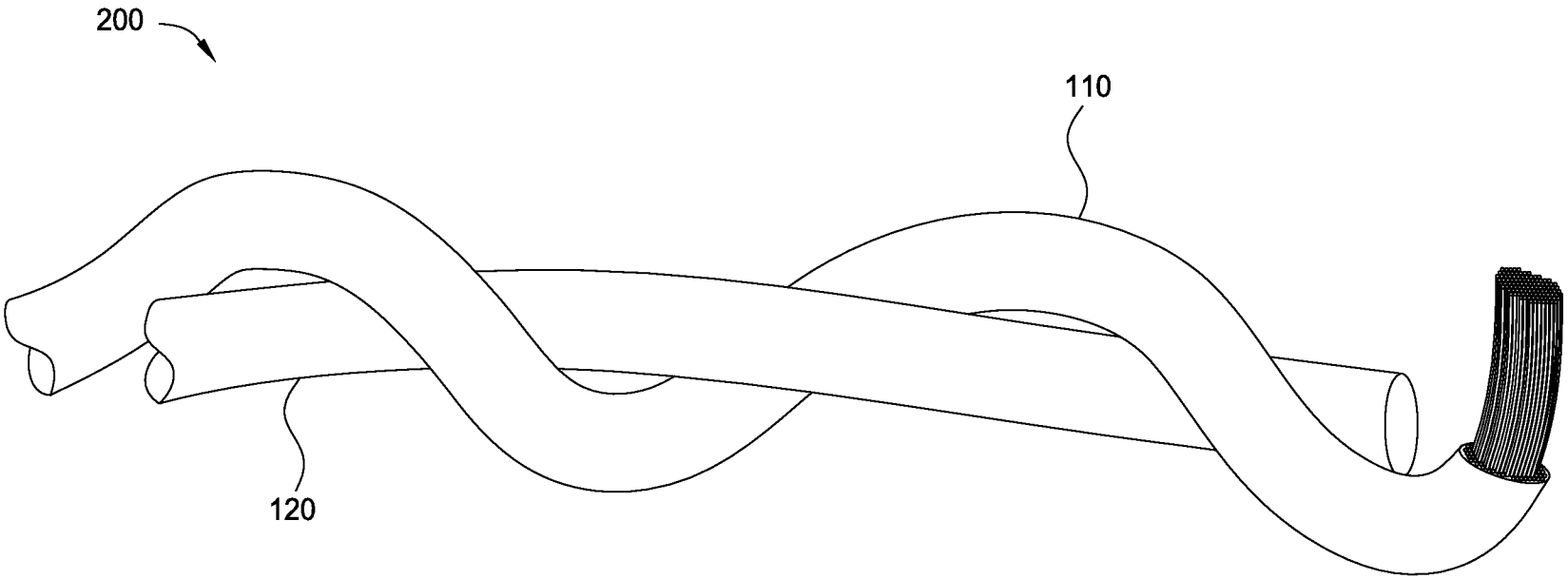
FIG. 2 is an enlarged partial perspective view of a multicomponent stranded yarn including a continuous ceramic strand wrapped around a continuous load-relieving process aid strand according to implementations described herein.

FIG. 2 is an enlarged partial perspective view of a multicomponent stranded yarn 200 including the continuous ceramic strand 110 served (wrapped) around the continuous load-relieving process aid strand 120 according to implementations described herein. The continuous load-relieving process aid strand 120 is typically under tension during the knitting process while reducing the amount of tension that the continuous ceramic strand 110 is subjected to during the knitting process. This reduction in tension typically leads to reduced breakage of the continuous ceramic strand 110.

The continuous ceramic strand 110 is typically wrapped around the continuous load-relieving process aid strand 120 prior to being drawn into the knitting system. The continuous ceramic strand 110 wrapped around the continuous load-relieving process aid strand 120 may be drawn into the knitting system through a single material feeder to create the desired knit fabric.

A serving process may be used to apply the continuous ceramic strand 110 to the continuous load-relieving process aid strand 120. Any device, which provides covering to the continuous load-relieving process aid strand 120, as by wrapping or braiding the continuous ceramic strand 110 around the continuous load-relieving process aid strand 120, such as a braiding machine or a serving/overwrapping machine, may be used. The continuous ceramic strand 110 can be wrapped on the continuous load-relieving process aid strand 120 in a number of different ways, i.e. the continuous ceramic strand 110 can be wrapped around the continuous load-relieving process aid strand 120 in both directions (double-served), or it can be wrapped around the continuous load-relieving process aid strand 120 in one direction only (single-served). In addition, the number of wraps per unit of length can be varied. For example, in one implementation, 0.3 to 3 wraps per inch (e.g., 0.1 to 1 wraps per cm) are used.

Figure 3:
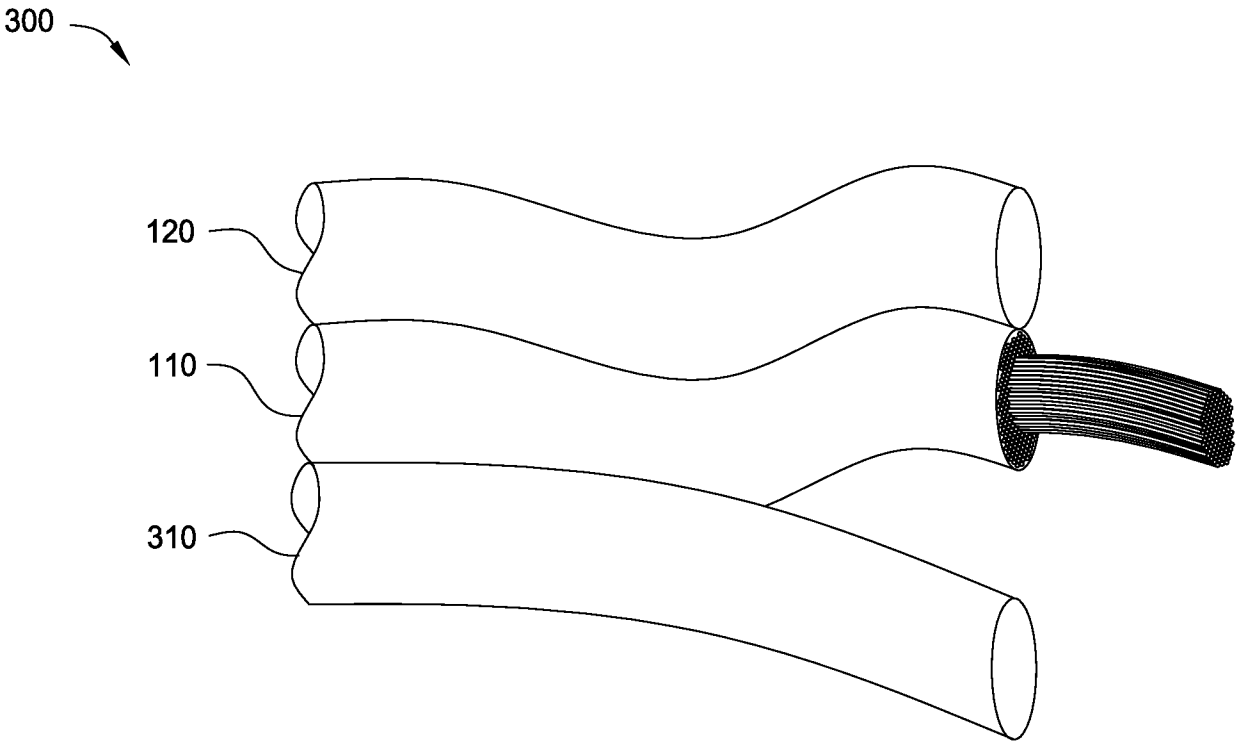
FIG. 3 is an enlarged partial perspective view of a multicomponent stranded yarn including a continuous ceramic strand, a continuous load-relieving process aid strand and a metal alloy wire prior to processing according to implementations described herein.

FIG. 3 is an enlarged partial perspective view of a multicomponent stranded yarn 300 including the continuous ceramic strand 110, the continuous load-relieving process aid strand 120 and a metal wire 310 prior to processing according to implementations described herein. As depicted in FIG. 3, the multicomponent stranded yarn 300 is a tri-component stranded yarn. The metal wire 310 provides additional support to the continuous ceramic strand 110 during the knitting process. The continuous load-relieving process aid strand 120 may be a polymeric monofilament as described herein. The continuous load-relieving process aid strand 120 and the continuous ceramic strand 110 may be both drawn into the knitting system through a single material feeder and "plated" together with the metal wire 310, which is drawn into the system through a second material feeder to create the desired knit fabric.

Similar to the previously described metal alloy materials of the continuous load-relieving process aid strand 120, the metal wire 310 may comprise continuous strands of nickel-chromium based alloys (e.g., Inconel® alloys, Inconel® alloy 718), nickel-chromium-molybdenum based alloys, aluminum, stainless steel, such as a low carbon stainless steel, for example, SS316L, which has high corrosion resistance properties. However, other conductive continuous strands of metal wire could be used, such as, copper, tin or nickel-plated copper, and other metal alloys, for example.

In implementations where the continuous load-relieving process aid strand 120 is heat fugitive (e.g., removed via a heat cleaning process), the metal wire 310 is typically selected such that it will withstand the heat cleaning process. In implementations where the metal wire 310 is a monofilament, the process aid strand may have a diameter from about 100 micrometers to about 625 micrometers (e.g., from about 150 micrometers to about 250 micrometers). In implementations where the metal wire 310 is a multifilament, the individual filaments of the multifilament may each have a diameter from about 10 micrometers to about 50 micrometers. In some implementations, the metal wire 310 is knit into the knit fabric in a soft-tempered state and later heat hardened after the desired shape of the final product is achieved.

Figure 4:
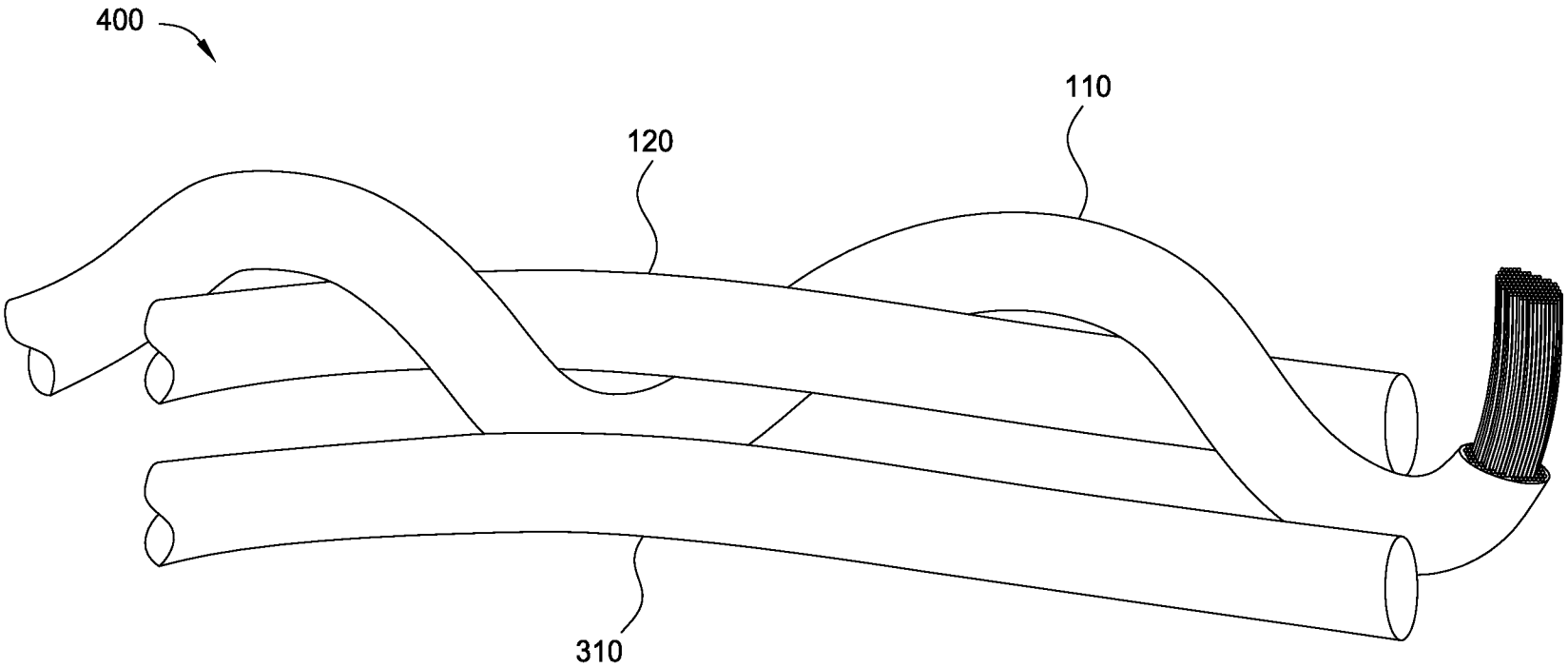
FIG. 4 is an enlarged partial perspective view of a multicomponent stranded yarn including a continuous ceramic strand wrapped around a continuous load-relieving process aid strand and a metal alloy wire according to implementations described herein.

FIG. 4 is an enlarged partial perspective view of another multicomponent stranded yarn 400 including the continuous ceramic strand 110 served around the continuous load-relieving process aid strand 120 and the metal wire 310 according to implementations described herein. As depicted in FIG. 4, the multicomponent stranded yarn 400 is a tri-component stranded yarn. The continuous load-relieving process aid strand 120 is a polymeric monofilament as described herein. The continuous ceramic strand 110 served around the continuous load-relieving process aid strand 120 are both drawn into the knitting system through a single material feeder and "plated" together with the metal wire 310 which is drawn into the system through a second material feeder to create the desired knit fabric.

Figure 5:
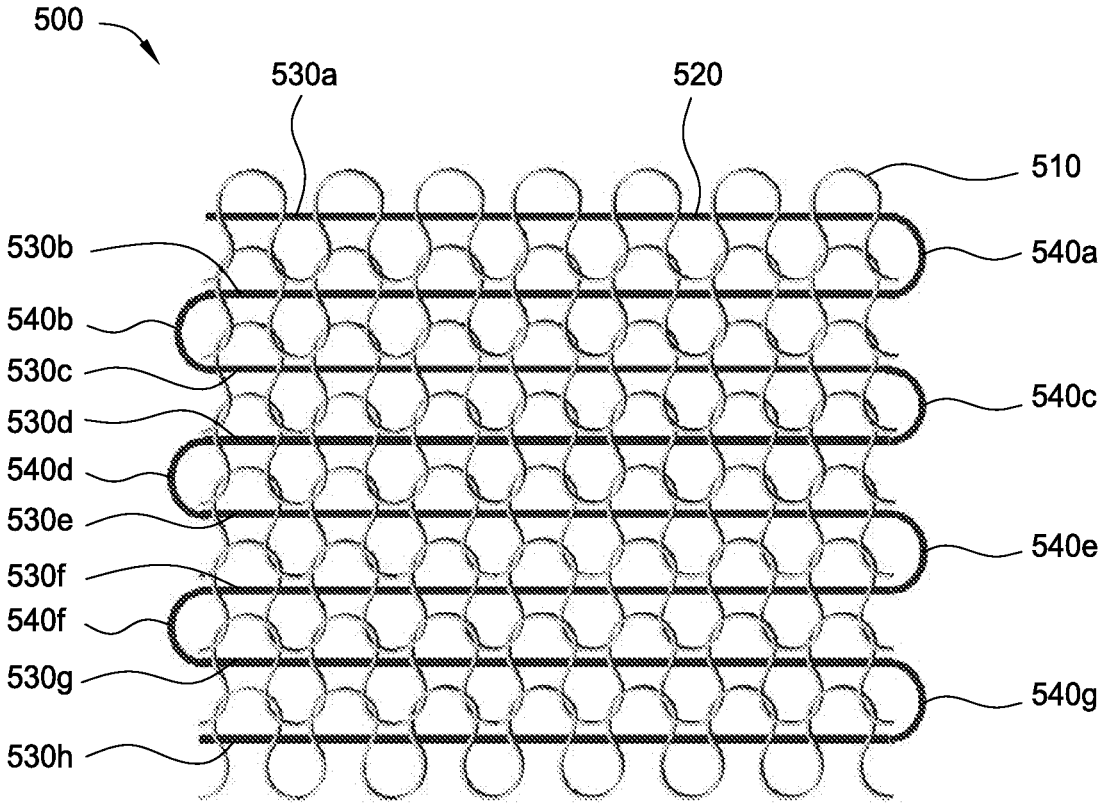
FIG. 5 is an enlarged perspective view of one example of a knit fabric that includes a multicomponent yarn and a fabric integrated inlay according to implementations described herein.

FIG. 5 is an enlarged perspective view of one example of a multicomponent yarn 510 in a knit fabric 500 that includes a wire inlay 520 integrated with the knit fabric 500 according to implementations described herein. The wire inlay 520 depicted in FIG. 5 is aligned with the knit direction of the knit fabric 500. The wire inlay 520 is periodically integrated with the knit fabric 500 to provide additional stiffness and strength to the knit fabric 500. In some implementations, the wire inlay 520 is interwoven with the knit fabric 500. The knit fabric 500 is a weft knitted structure with a horizontal row of loops made by knitting the multicomponent yarn 510 in a horizontal direction (i.e., the knit direction). The wire inlay 520 is a continuous inlay including straight wire segments 530*a*-530*h* with alternating curved wire segments 540*a*-540*g* connecting each straight wire segment to an adjacent straight wire segment (for example, straight wire segment 530*a* and straight wire segment 530*b* are connected by curved wire segment 540*a*). Each straight wire segment 530*a*-530*h* of the wire inlay 520 is aligned parallel to the knit direction of the multicomponent yarn 510.

The wire inlay 520 may have variable spacing to account for regions, which require more or less stiffness. For example, wire inlay 520 may have uniform or non-uniform spacing between adjacent straight wire segments. In the implementation depicted in FIG. 5, the wire inlay 520 has uniform spacing between the adjacent straight wire segments of the wire inlay 520. One or multiple feeds of wire inlays can be used to create the desired architecture of the final component.

Figure 6:
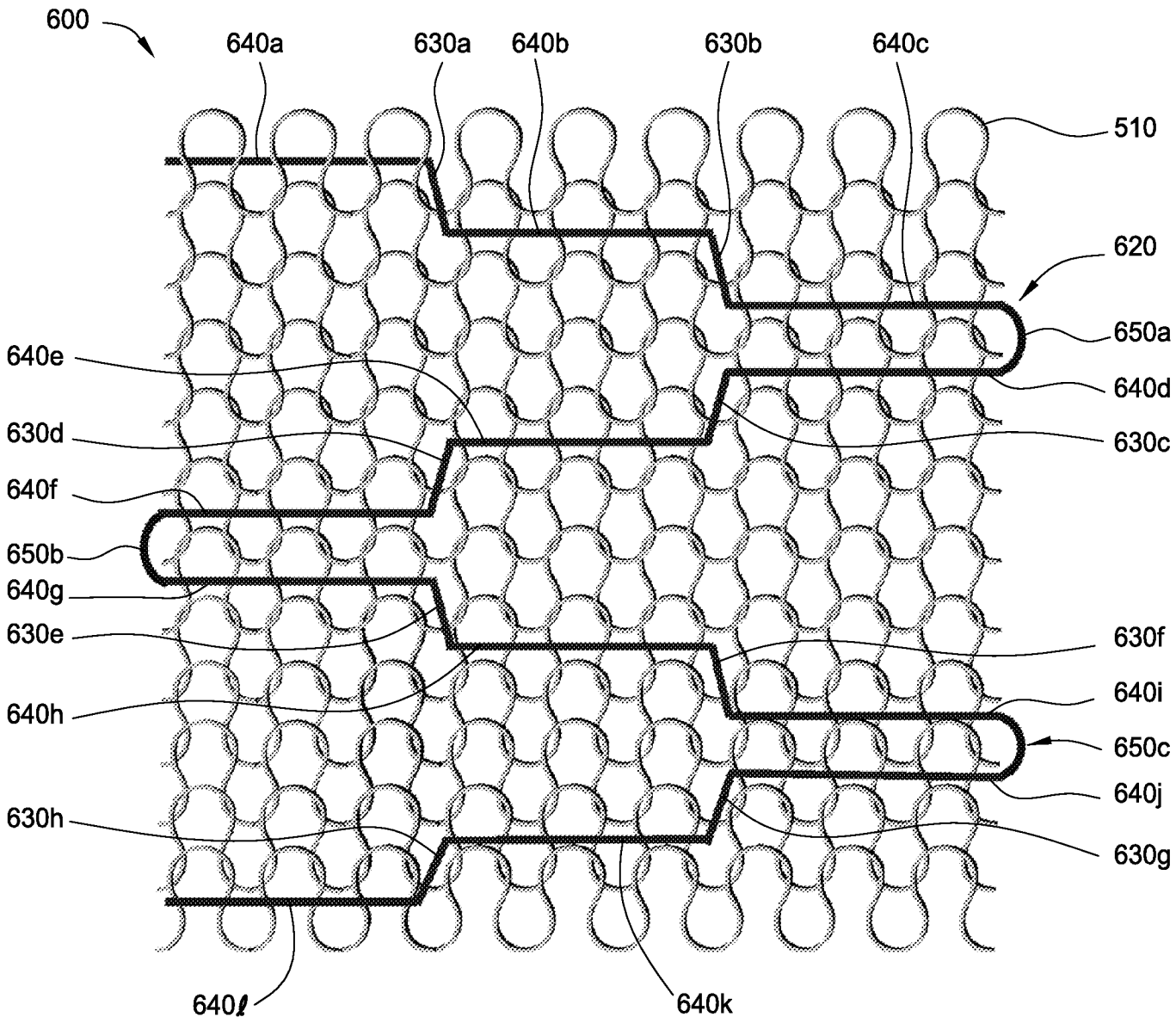
FIG. 6 is an enlarged perspective view of yet another example of a knit fabric that includes a multicomponent yarn and a fabric integrated inlay according to implementations described herein.

FIG. 6 is an enlarged perspective view of yet another example of a knit fabric 600 that includes a multicomponent yarn 510 and a wire inlay 620 integrated with the knit fabric 600. The knit fabric 600 is a weft-knitted structure with a horizontal row of loops made by knitting the multicomponent yarn 510 in a horizontal direction (i.e., the knit direction). The knit fabric 600 is similar to knit fabric 500 depicted in FIG. 5 except that the wire inlay 620 includes straight wire segments 630*a*-630*h* that are angled relative to the knit direction of the knit fabric 600, straight wire segments 640*a*-640*l* that are aligned with the knit direction of the knit fabric 600, and curved wire segments 650*a*-650*c*.

The wire inlay 620 is a continuous inlay including straight wire segments 640*c* and 640*d* aligned with the knit direction, straight wire segments 640*f* and 640*g* aligned with the knit direction, and straight wire segments 640*i* and 640*j* aligned with the knit direction with alternating curved wire segments 650*a*, 650*b* and 650*c* connecting each straight wire segment to an adjacent straight wire segment (i.e., straight wire segment 640*c* and straight wire segment 640*d* are connected by curved wire segment 650*a*). Each straight wire segment 640*c*, 640*d*, 640*f*, 640*g*, 640*i* and 640*j* of the wire inlay 620 is aligned parallel to the knit direction of the multicomponent yarn 510.

The wire inlay 620 further includes angled straight wire segment 630*a* which connects aligned straight wire segments 640*a* and 640*b*, angled straight wire segment 630*b* which connects aligned straight wire segments 640*b* and 640*c*, angled straight wire segment 630*c* which connects aligned straight wire segments 640*d* and 640*e*, angled straight wire segment 630*d* which connects aligned straight wire segments 640*e* and 640*f*, angled straight wire segment 630*e* which connects aligned straight wire segments 640*g* and 640*h*, angled straight wire segment 630*f* which connects aligned straight wire segments 640*k* and 640*l*, angled straight wire segment 630*g* which connects aligned straight wire segments 640*j* and 640*k*, and angled straight wire segment 630*h* which connects aligned straight wire segments 640*k* and 640*l*.

As discussed herein, the wire inlay 620 may have variable spacing, uniform spacing, or both to account for regions, which require more or less stiffness. As depicted in FIG. 6, the wire inlay 620 may have variable spacing to account for regions, which require more or less stiffness. For example, the spacing between each pair of parallel aligned straight wire segments, for example, 640*c* and 640*d*, 640*b* and 640*e*, 640*a* and 640*f*, increases as each pair of parallel aligned straight wire segment moves away from each curved wire segment 650*a*-650*c*. One or multiple feeds of the wire inlay 620 can be used to create the desired architecture of the final product.

Figure 7:
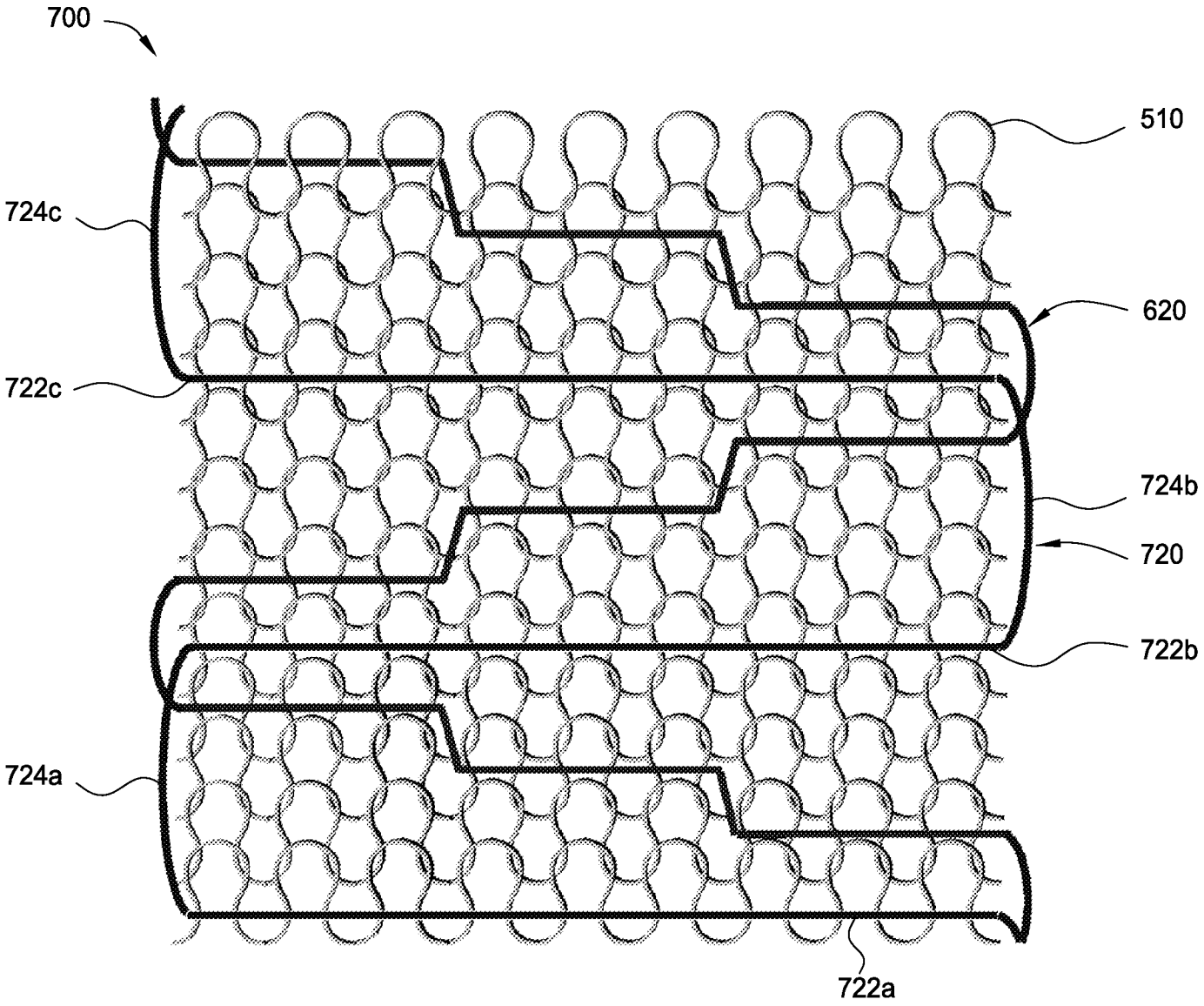
FIG. 7 is an enlarged perspective view of yet another example of a knit fabric that includes a multicomponent yarn and multiple fabric integrated inlays according to implementations described herein.

FIG. 7 is an enlarged perspective view of yet another example of a knit fabric 700 that includes a multicomponent yarn 510 and multiple overlapping wire inlays 620, 720 integrated with the knit fabric 700 according to implementations described herein. The knit fabric 700 is a weft-knitted structure with a horizontal row of loops made by knitting the multicomponent yarn 510 in a horizontal direction (i.e., the knit direction). The knit fabric 700 is similar to knit fabrics 500 and 600 depicted in FIG. 5 and FIG. 6 except that the knit fabric 700 includes overlapping wire inlays 720 and 620. Wire inlays 620 and 720 have segments aligned with the knit direction of the knit fabric 700.

The wire inlay 720 is a continuous inlay including straight wire segments 722*a*-722*c* with alternating curved wire segments 724*a*-724*c* connecting each straight wire segment to an adjacent straight wire segment (i.e., straight wire segment 722*a* and straight wire segment 722*b* are connected by curved wire segment 724*a*). Each straight wire segment 722*a*-722*c* of the wire inlay 720 is aligned parallel to the knit direction of the multicomponent yarn 510. The spacing between adjacent straight wire segments of the wire inlay 720 is depicted as uniform. However, in some implementations, spacing between adjacent wire segments of the wire inlay 720 may be variable to account for regions, which require more or less stiffness.

The wire inlays 520, 620 and 720 may be composed of any of the aforementioned metal or ceramic materials. The wire inlays 520, 620 and 720 typically comprise a larger diameter material (e.g., from about 300 micrometers to about 3,000 micrometers) that either cannot be knit or is difficult to knit due to the diameter of the wire inlay and the gauge of the knitting machine. However, it should be understood that the diameter of the material that can be knit is dependent upon the gauge of the knitting machine and as a result, different knitting machines can knit materials of different diameters. The wire inlays 520, 620 and 720 may be placed in the knit fabric 500, 600, 700 by laying the wire inlays 520, 620 and 720 in between adjacent stitches for an interwoven effect.

The multicomponent yarn 510 may be any of the multicomponent yarns depicted in FIGS. 1-4. Although FIGS. 5-7 depict a jersey knit fabric zone, it should be noted that the depiction of a jersey knit fabric zone is only exemplary and that the implementations described herein are not limited to jersey knit fabrics. Any suitable knit stitch and density of stitch can be used to construct the knit fabrics described herein. For example, jersey, interlock, rib-forming stitches, combinations thereof or otherwise may be used.

Although FIGS. 5-7 depict a weft-knitted structure, it should be understood that the implementations described herein might be used with other knit structures including, for example, warp-knitted structures. In a warp-knitted fabric, where the knit direction is vertical, the wire inlays may be positioned normal to the knit direction. It should also be understood that the wire inlay designs depicted in FIGS. 5-7 are only examples, and that other wire inlay designs may be used with the implementations disclosed herein. For example, in some implementations where segments of the wire inlay are angled relative to the knit direction, the angled wire segments of the inlay may be positioned at a 2 degree to 60 degree angle relative to the knit direction (e.g., at a 5 degree to 30 degree angle relative to the knit direction; at a 9 degree to 20 degree angle relative to the knit direction).

Figure 8:
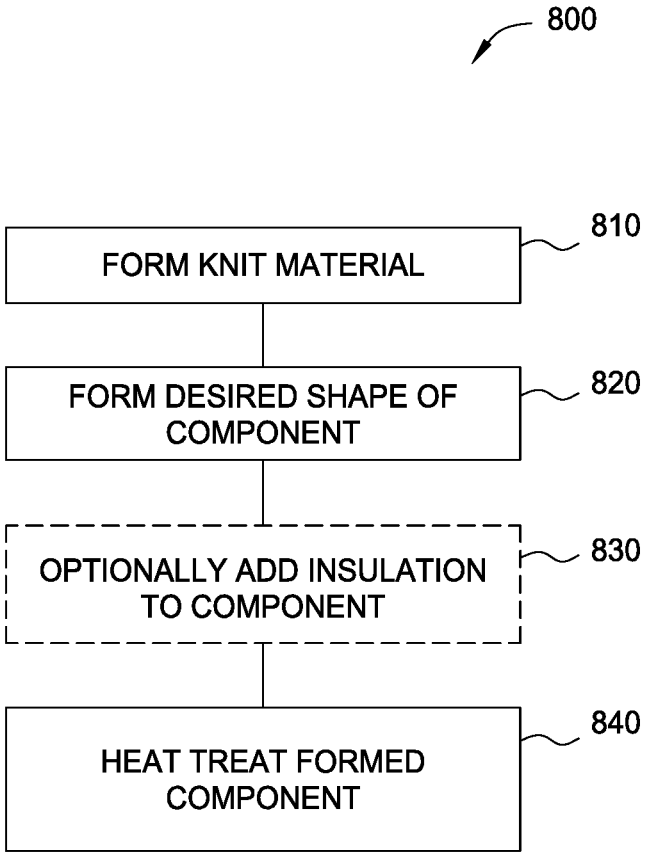
FIG. 8 is a process flow diagram for forming a thermal sealing member according to implementations described herein.

FIG. 8 is a process flow diagram 800 for forming a thermal sealing member according to implementations described herein. At operation 810, the knit fabric is formed. In some implementations, a continuous ceramic strand and a continuous load-relieving process aid strand are concurrently knit to form a knit fabric. The continuous ceramic strand and the continuous load-relieving process aid strand may be as previously described above. The strands may be concurrently knit on a flat-knitting machine, a tubular-knitting machine, or any other suitable knitting machine. The continuous ceramic strand and the continuous load-relieving strand may be simultaneously fed into a knitting machine through a single material feeder to form a multi-component yarn. In implementations where the continuous ceramic strand is wrapped around the continuous load-relieving process aid strand (e.g., as depicted in FIG. 2 and FIG. 4), the continuous ceramic strand may be wrapped around the continuous process aid strand prior to simultaneously feeding the continuous ceramic strand and the continuous load-relieving process aid strand into the knitting machine. A serving machine/overwrapping machine may be used to wrap the ceramic fiber strand around the continuous load-relieving process aid strand. Although knitting may be performed by hand, the commercial manufacture of knit components is generally performed by knitting machines. Any suitable knitting machine may be used. The knitting machine may be a single double-flatbed knitting machine.

In some implementations where the multicomponent stranded yarn further comprises a metal alloy wire the bi-component yarn may be fed through a first material feeder and the metal alloy wire may be simultaneously fed through a second material feeder to form the knit fabric. The strands may be concurrently knit to form a single-layer. The metal alloy wire may be knit in a soft-tempered state, which is later hardened by a heat hardening process.

In some implementations, a wire inlay is added to the knit fabric. The wire inlay may be any of the aforementioned metal or ceramic materials. In implementations that contain both a metal alloy wire that is co-knit and a wire inlay, the wire inlay has a larger diameter than the metal alloy wire. The wire inlay typically comprises a larger diameter material (e.g., from about 300 micrometers to about 3,000 micrometers; from about 400 micrometers to about 700 micrometers) that either cannot be knit or is difficult to knit due to the diameter of the wire inlay and the gauge of the knitting machine. However, it should be understood that the diameter of the material that can be knit is dependent upon the gauge of the knitting machine and as a result, different knitting machines can knit materials of different diameters. The wire inlay may be placed in the knit fabric by laying the wire inlay in between opposing stitches for an interwoven effect.

In some implementations where a tubular-knitting technique is used, one or more alloy wires can be floated across opposing needle beds, which can provide additional stiffness and support after the seal is expanded to shape and heat hardened.

At operation 820, the knit fabric is formed into the desired shape of the final component. The desired shape is typically formed while the metal alloy wire and fabric integrated inlay are in a soft formable state. The knit fabric can be laid up into a preform or fit on a mandrel to form the desired shape of the final component.

At operation 830, the insulation material is optionally added to the interior of the formed component. Any insulation material capable of withstanding desired temperatures may be used. Exemplary insulation materials include fiberglass and ceramics. Alternatively, other widely available high temperature materials such as zirconia, alumina, aluminum silicate, aluminum oxide, and high temperature glass fibers may be employed. In some implementations, the insulation material is stitched to the knit fabric. The insulation material may be added at any time during formation of the component. For example, the insulation material may be added prior to shaping the knit fabric into the component or after the knit fabric is shaped into the final component. In some implementations, where the knit fabric is formed using a tubular-knitting process, the insulation may be inserted into the tube during knit fabrication.

In some implementations, the knit fabric is stitched together to form the final component. The knit fabric is typically stitched together to form the final component while the metal alloy wire and the wire inlay are in a soft formable state. However, in some implementations, the knit fabric may be stitched together after the metal alloy wire and the wire inlay are hardened.

At operation 840, the formed component is heat treated. In implementations where no metal alloy is present in the knit fabric, the ceramic-based fiber may be heat cleaned and heat treated to the manufacturer's specifications. This heat treatment process removes any sizing on the fiber, as well as removing the process aid fiber. In implementations where the metal alloy is present, the metal is heat hardened to standard specifications. The heat hardening cycle also serves to remove the sizing on the ceramic-based fiber as well as the processing aid. In implementations where the process aid is a sacrificial process aid, the knit fabric is exposed to a process aid removal process. Depending upon the material of the process aid, the process aid removal process may involve exposing the knit fabric to solvents, heat and/or light. In some implementations where the process aid is removed via exposure to heat (e.g., heat fugitive), the knit fabric may be heated to a first temperature to remove the load-relieving process aid. It should be understood that the temperatures used for process aid removal process are material dependent.

In some implementations, the knit fabric is exposed to a strengthening heat treatment process. The knit fabric may be heated to a second temperature greater than the first temperature to anneal the ceramic strand. Annealing the ceramic strand may relax the residual stresses of the ceramic strand allowing for higher applied stresses before failure of the ceramic fibers. Elevating the temperature above the first temperature of the heat clean may be used to strengthen the ceramic and simultaneously strengthen the metal wire if present. After elevating the temperature above the first temperature, the temperature may then be reduced and held at various temperatures for a period of time in a step down tempering process. It should be understood that the temperatures used for the strengthening heat treatment process are material dependent.

In one exemplary implementation where the process aid is Nylon 6,6, the ceramic strand is Nextel™ 312, and the metal alloy wire is Inconel® 718, after knitting, the knit fabric is exposed to a heat treatment process to heat clean/burn off the Nylon 6,6 process aid. Once the Nylon 6,6 process aid is removed, a strengthening heat treatment that both Inconel® 718 and Nextel™ 312 can withstand is performed. For example, while heating the material to 1,000 degrees Celsius the Nylon 6,6 process aid burns off at a first temperature less than 1,000 degrees Celsius. The temperature is reduced from 1,000 degrees Celsius to about 700 to 800 degrees Celsius where the temperature is maintained for a period of time and down to 600 degrees Celsius for a period of time. Thus, this heat treatment process simultaneously anneals the Nextel™ 312 ceramic while grain growth and recrystallization of the Inconel® 718 wire occurs. Thus, simultaneous strengthening of the metal wire and subsequent heat treatment of the ceramic are achieved.

The knit fabric may be impregnated with a selected settable impregnate which is then set. The knit fabric may be laid up into a preform or fit into a mandrel prior to impregnation with the selected settable impregnate. Suitable settable impregnates include any settable impregnate that is compatible with the knit fabric. Exemplary suitable settable impregnates include organic or inorganic plastics and other settable moldable substances, including glass, organic polymers, natural and synthetic rubbers and resins. The knit fabric may be infused with the settable impregnate using any suitable liquid-molding process known in the art. The infused knit fabric may then be cured with the application of heat and/or pressure to harden the knit fabric into the final molded product.

One or more filler materials may also be incorporated into the knit fabric depending upon the desired properties of the final knit product. The one or more filler materials may be fluid resistant. The one or more filler materials may be heat resistant. Exemplary filler material include common filler particles such as carbon black, mica, clays such as e.g., montmorillonite clays, silicates, glass fiber, carbon fiber, and the like, and combinations thereof.

In addition to the continuous ceramic strand, the knit fabric may further comprise a second fiber component. The second fiber component may be selected from the group consisting of: ceramics, glass, minerals, thermoset polymers, thermoplastic polymers, elastomers, metal alloys, and combinations thereof. The continuous ceramic strand and the second fiber component can comprise the same or different knit stitches. The continuous ceramic strand and the second fiber component may be concurrently knit in a single-layer. The continuous ceramic strand and the second fiber can comprise the same knit stitches or different knit stitches. The continuous ceramic strand and the second fiber may be knit as integrated separate regions of the final knit product. Knitting as integrated separate regions may reduce the need for cutting and sewing to change the characteristics of that region. The knit integrated regions may have continuous fiber interfaces, whereas the cut and sewn interfaces do not have continuous interfaces making integration of the previous functionalities difficult to implement (e.g., electrical conductivity). The continuous ceramic strand and the second fiber component may each be inlaid in warp and/or weft directions.

The knit fabrics described herein may be knit into multiple layers. Knitting the knit fabrics described herein into multiple layers allows for combination with fabrics having different properties (e.g., structural, thermal or electric) while maintaining peripheral connectivity or registration within/between the layers of the overall fabric. The multiple layers may have intermittent stitch or inlaid connectivity between the layers. This intermittent stitch or inlaid connectivity between the layers may allow for the tailoring of functional properties/connectivity over shorter length scales (e.g., <0.25"). For example, with two knit outer layers with an interconnecting layer between the two outer layers. The multiple layers may contain pockets or channels. The pockets or channels may contain electrical wiring, sensors or other electrical functionality. The pockets or channels may contain one or more filler materials.

The one or more filler materials may be selected to enhance the desired properties of the final knit product. The one or more filler materials may be fluid resistant. The one or more filler materials may be heat resistant. Exemplary filler material include common filler particles such as carbon black, mica, clays such as e.g., montmorillonite clays, silicates, glass fiber, carbon fiber, and the like, and combinations thereof.

Figure 9:
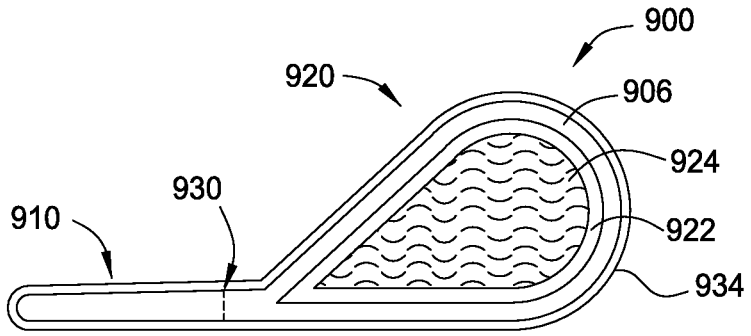
FIG. 9 is a schematic cross-sectional view of an exemplary thermal sealing member including a metal alloy knit fabric according to implementations described herein.

FIG. 9 is a schematic cross-sectional view of an exemplary thermal sealing member 900 including a metal alloy knit fabric according to implementations described herein. The thermal sealing member 900 is a p-type bulb seal formed from tab portion 910 that is coupled to a bulb portion 920. The thermal sealing member 900 comprises an intermediate wrap member 906 and an outer abrasion-resistant wrap member 934. The outer abrasion-resistant wrap member 934 protects the intermediate wrap member 906.

The intermediate wrap member 906 is constructed from one or more layers of a ceramic-based fiber material. In one implementation, the ceramic-based fiber material has an alumina-boria-silica composition. In one implementation, the ceramic-based fiber material is a single-layer ceramic-based knit fabric as previously described in FIGS. 1-8.

In some implementations, the thermal sealing member further comprises a core member 922 constructed of a resilient material having spring-like properties. The core member 922 serves as a flexible internal structural support preventing the thermal sealing member 900 from collapsing upon itself during operation. In some implementations, the core member 922 is formed by roll forming. In some implementations where the core member 922 is present, the intermediate wrap member 906 covers the core member 922.

The core member 922 may be fabricated from a superalloy metal including nickel-, iron-, and cobalt based superalloys. Exemplary commercial superalloys include Inconel® alloys, Inconel® alloy 718, and Haynes® 188 alloy. In some implementations, the core member 922 is a material selected from the group consisting of stainless steel, ceramic material, a nickel-chromium superalloy, and combinations thereof.

In some implementations, the thermal sealing member further comprises an insulating material 924 (e.g., fiberglass, ceramic, etc.). In some implementations, if present, the insulating material 924 fills the core member 922. In some implementations, where the core member 922 is not present, the insulating material may fill the intermediate wrap member 906.

In some implementations, both the tab portion 910 and the bulb portion 920 are made from the ceramic-based knit fabric described herein. In some implementations, the bulb portion 920 is further filled with the insulating material 924 (e.g., fiberglass, ceramic, etc.). Of course, it should be noted that in some implementations, not only the bulb portion 920 but also the tab portion 910 is at least partially filled with a thermally insulating material. In some implementations, the tab portion 910 is sewn (here, via stitching 930) or otherwise coupled to the bulb portion 920 to complete a pliable (typically manually deformable) seal. In some implementations, one or more abrasion-resistant wrap members 934 may be added to the thermal sealing member 900 for a variety of purposes, for example, increased durability, increased heat resistance, or both.

While the exemplary bulb seal of FIG. 9 is drawn with certain proportions, it should be appreciated that numerous modifications are also contemplated. For example, and with further reference to the cross-sectional view of the bulb seal in FIG. 9, the tab portion may extend significantly further to the left to have a width that is up to 2-fold, up to 5-fold, and even up to 10-fold (or even more) than the width of the bulb portion. Similarly, the bulb portion may extend significantly further to the right to have a width that is up to 2-fold, up to 5-fold, and even up to 10-fold (or even more) than the width of the tab portion. Moreover, it should be noted that in some implementations, additional (e.g., second, third, fourth, etc.) tab portions are provided to the bulb portion, wherein the additional tab portions may extend into the same direction or in opposite directions. Likewise, where desirable, one or more bulb portions may be coupled to the tab portion(s), especially where the end surface is relatively large. Therefore, it should be recognized that in some implementations, the bulb seal includes multiple bulb portions that are most preferably formed from a single sheet (e.g., a double bulb seal). In such alternative structures, the bulb portions are preferably sequentially arranged, but may (alternatively or additionally) also be stacked. Thus, seals are also contemplated in which at least one of the bulbs is filled with a different insulating material than the remaining bulbs (e.g., to accommodate to different heat exposure).

Figure 10A:
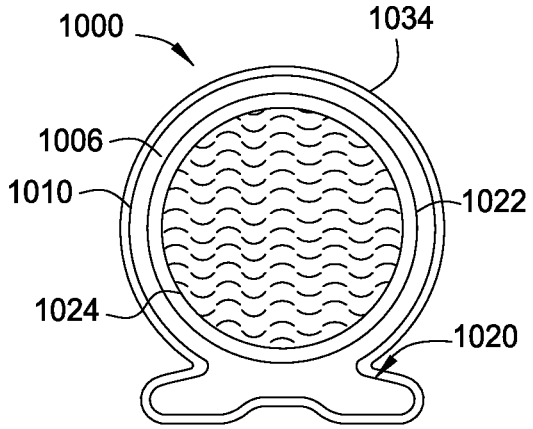
FIGS. 10A-10B are schematic cross-sectional views of another thermal sealing member including a metal alloy knit fabric according to implementations described herein.
Figure 10B:
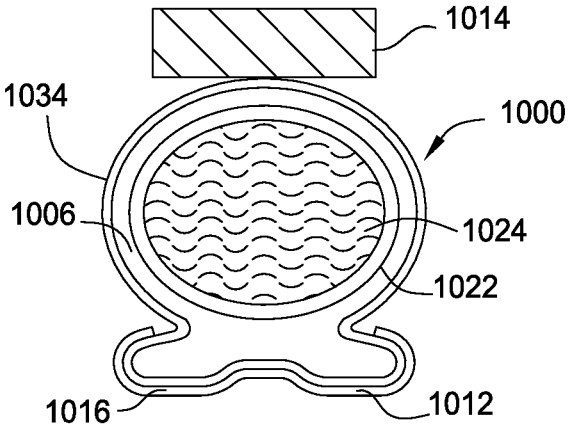

FIGS. 10A-10B are schematic cross-sectional views of another thermal sealing member 1000 including a metal alloy knit fabric according to implementations described herein. The thermal sealing member 1000 is an omega-type bulb seal formed from a bulb portion 1010 and a split base 1020. The thermal sealing member 1000 comprises an intermediate wrap member 1006 and an outer abrasion-resistant wrap member 1034. The outer abrasion-resistant wrap member 1034 protects the intermediate wrap member 1006.

The intermediate wrap member 1006 is constructed from one or more layers of a ceramic-based fiber material. In one implementation, the intermediate wrap member 1006 has an alumina-boria-silica composition. In one implementation, the intermediate wrap member 1006 is a single-layer ceramic-based knit fabric as previously described if FIGS. 1-8.

In some implementations, the thermal sealing member 1000 further comprises a core member 1022 constructed of a resilient material having spring-like properties. The core member 1022 serves as a flexible internal structural support preventing the thermal sealing member 1000 from collapsing upon itself during operation. In some implementations, the core member 1022 is formed by roll forming. In some implementations where the core member 1022 is present, the intermediate wrap member 1006 covers the core member 1022.

The core member 1022 may be fabricated from a superalloy metal including nickel-, iron-, and cobalt based superalloys. Exemplary commercial superalloys include Inconel® alloys, Inconel® alloy 718, and Haynes® 188 alloy. In some implementations, the core member 1022 is a material selected from the group consisting of stainless steel, ceramic material, a nickel-chromium superalloy, and combinations thereof.

In some implementations, the thermal sealing member 1000 further comprises an insulating material 1024 (e.g., fiberglass, ceramic, etc.). In some implementations, if present, the insulating material 1024 fills the core member 1022. In some implementations, where the core member 1022 is not present, the insulating material may fill the intermediate wrap member 1006.

In some implementations, both the bulb portion 1010 and the split base 1020 are made from the ceramic-based knit fabric described herein. The outer configuration of the split base 1020 defines a seat that fits within and mates with a channel 1016 to provide firm mechanical seating and support. Although such channels are widely used for mounting bulb seals, these channels are not required for seal structures in accordance with the implementations described herein because a wide range of other expedients for mounting or positioning the seal structure can be used. In some implementations, the bulb portion 1010 is further filled with insulating material 1024 (e.g., fiberglass, ceramic, etc.). In some implementations, one or more outer abrasion-resistant wrap members 1034 may be added to the thermal sealing member 1000 for a variety of purposes, for example, increased durability, increased heat resistance, or both.

FIG. 10B is a cross-sectional view of the thermal sealing member 1000 mounted between opposing surfaces. In FIG. 10B, the thermal sealing member 1000 is mounted between a firewall 1012 which may be assumed for this example to be the forward part of an aircraft body, and an opposing member 1014 which in this instance is a portion of an engine nacelle facing and spaced apart from the firewall 1012. The firewall 1012 includes the recessed channel 1016 for receiving the split base 1020 of the thermal sealing member 1000. The thermal sealing member 1000 is seated within and positioned relative to the recessed channel 1016 and the opposing member 1014.

Figure 11A:
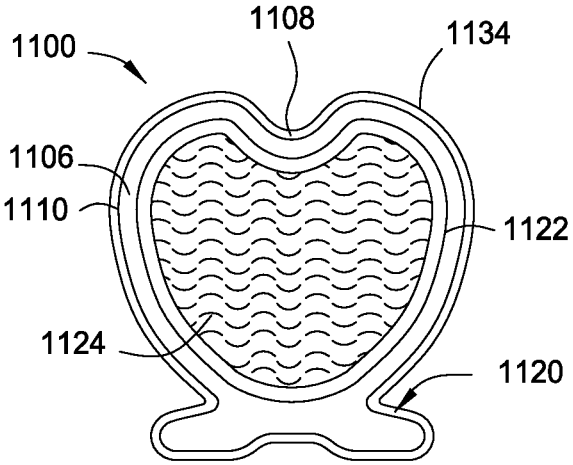
FIGS. 11A-11B are schematic cross-sectional views of another thermal sealing member including a metal alloy knit fabric according to implementations described herein.
Figure 11B:
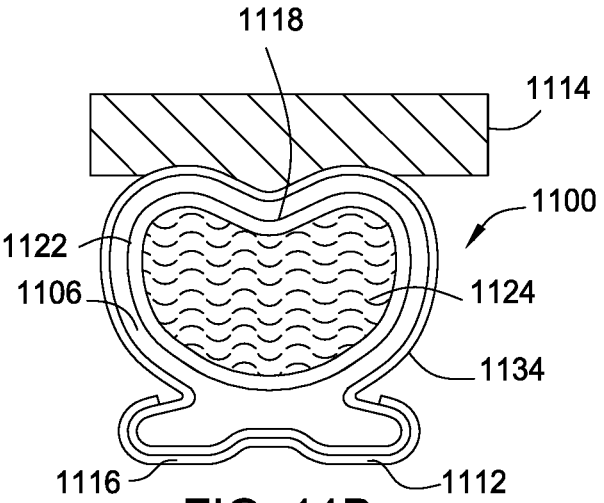

FIG. 11A-11B are schematic cross-sectional views of another thermal sealing member 1100 including a metal alloy knit fabric according to implementations described herein. The thermal sealing member 1100 is an M-type or heart shaped type bulb seal formed from a bulb portion 1110 and a split base 1120. The bulb portion 1110 has a concave portion 1108 for mating with an opposing convex surface. The thermal sealing member 1100 comprises an intermediate wrap member 1106 and an outer abrasion-resistant wrap member 1134. The outer abrasion-resistant wrap member 1134 protects the intermediate wrap member 1106.

The intermediate wrap member 1106 is constructed from one or more layers of a ceramic-based fiber material. In one implementation, the intermediate wrap member 1106 has an alumina-boria-silica composition. In one implementation, the intermediate wrap member 1106 is a single-layer ceramic-based knit fabric as previously described in FIGS. 1-8.

In some implementations, the thermal sealing member 1100 further comprises a core member 1122 constructed of a resilient material having spring-like properties. The core member 1122 serves as a flexible internal structural support preventing the thermal sealing member 1100 from collapsing upon itself during operation. In some implementations, the core member 1122 is formed by roll forming. In some implementations where the core member 1122 is present, the intermediate wrap member 1106 covers the core member 1122.

The core member 1122 may be fabricated from a superalloy metal including nickel-, iron-, and cobalt based superalloys. Exemplary commercial superalloys include Inconel® alloys, Inconel® alloy 718, and Haynes® 188 alloy. In some implementations, the core member 1122 is a material selected from the group consisting of stainless steel, ceramic material, a nickel-chromium superalloy, and combinations thereof.

In some implementations, the thermal sealing member 1100 further comprises an insulating material 1124 (e.g., fiberglass, ceramic, etc.). In some implementations, if present, the insulating material 1124 fills the core member 1122. In some implementations, where the core member 1122 is not present, the insulating material may fill the intermediate wrap member 1106.

In some implementations, both the bulb portion 1110 and the split base 1120 are made from the ceramic-based knit fabric described herein. The outer configuration of the split base 1120 defines a seat that fits within and mates with a recessed channel 1116 to provide firm mechanical seating and support. Although such channels are widely used for mounting bulb seals, these channels are not required for seal structures in accordance with the implementations described herein because a wide range of other expedients for mounting or positioning the seal structure can be used. In some implementations, the bulb portion 1110 is further filled with insulating material 1124 (e.g., fiberglass, ceramic, etc.). In some implementations, one or more additional outer abrasion-resistant wrap members 1134 may be added to the thermal sealing member 1100 for a variety of purposes, for example, increased durability, increased heat resistance, or both.

FIG. 11B is a cross-sectional view of the thermal sealing member 1100 mounted between opposing surfaces. In FIG. 11B, the thermal sealing member 1100 is mounted between a firewall 1112 which may be assumed for this example to be the forward part of an aircraft body, and an opposing member 1114 which in this instance is a portion of an engine nacelle facing and spaced apart from the firewall 1112. The firewall 1112 includes the recessed channel 1116 for receiving the split base 1120 of the thermal sealing member 1100 while the opposing member 1114 incorporates a convex groove 1118 opposite to and paralleling the recessed channel 1116 for mating with the concave portion 1108 of the thermal sealing member 1100. The thermal sealing member 1100 is seated within and positioned relative to the recessed channel 1116 and the opposing member 1114.

It should be understood that the implementations described herein are not limited to the seal geometries depicted in FIGS. 9-11. In addition to the seal geometries depicted in FIGS. 9-11, the seals can be curvilinear or discrete and can also incorporate other geometric features such as holes, additional flanges, or overlapping flaps for attachment to other structures, for insulation enclosure, or both. Further, in some implementations that layers that comprise the thermal sealing members may be roll-formed. Furthermore, one or more additional external layers may be added to the seal designs described herein for a variety of purposes, for example, increased durability, increased heat resistance, or both.

Figure 12:
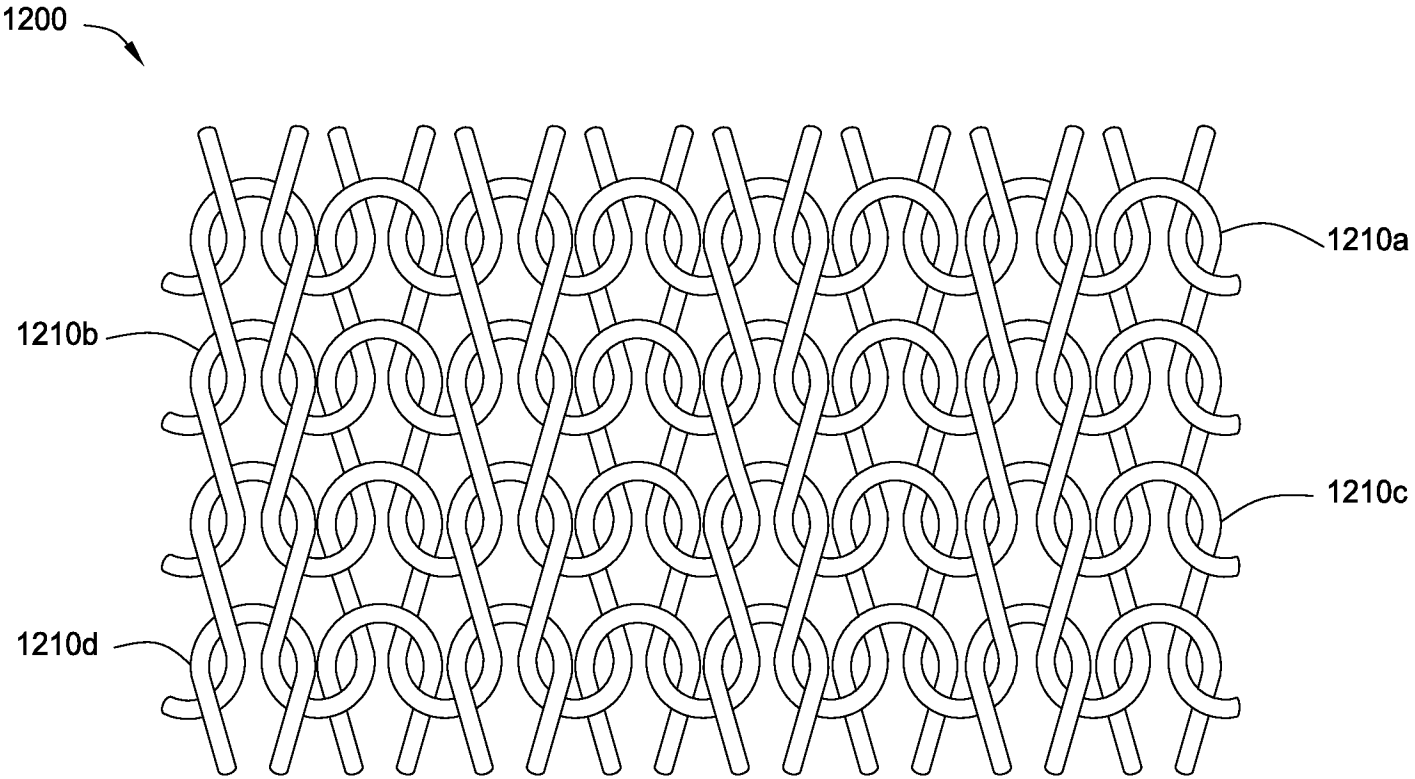
FIG. 12 is an enlarged perspective view of one example of a metal alloy knit fabric according to implementations described herein.

FIG. 12 is an enlarged perspective view of one example of a metal alloy knit fabric 1200 according to implementations described herein. The metal alloy knit fabric 1200 can withstand temperatures greater than or equal to 800 degrees Fahrenheit. The metal alloy knit fabric 1200 can withstand temperatures greater than or equal to 900 degrees Fahrenheit. The metal alloy knit fabric 1200 can withstand temperatures greater than or equal to 1,000 degrees Fahrenheit (e.g., in the range of 1,000 degrees Fahrenheit to 1,300 degrees Fahrenheit; in the range of 1,000 degrees Fahrenheit to 1,200 degrees Fahrenheit; in the range of 1,200 degrees Fahrenheit to 1,300 degrees Fahrenheit; in the range of 1,100 degrees Fahrenheit to 1,300 degrees Fahrenheit). The metal alloy knit fabric 1200 may be a single-layer fabric. The metal alloy knit fabric 1200 includes metal alloy wires 1210*a*-1210*d* (collectively 1210). The metal alloy wires 1210 form a plurality of intermeshed knit loops. The plurality of intermeshed knit loops define multiple horizontal courses and vertical wales. The metal alloy knit fabric 1200 is a weft-knitted structure with a horizontal row of loops made by knitting the metal alloy wires 1210 in a horizontal direction. Although the metal alloy knit fabric 1200 is depicted as a weft-knitted fabric, it should be understood that the metal alloy wires 1210 might be knit as other fabrics, for example, a warp-knitted fabric where the knit direction is vertical. The metal alloy knit fabric 1200 may be used as the one or more abrasion-resistant wrap members 934, 1034, and 1134 of thermal sealing members 900, 1000, and 1100.

Although FIG. 12 depicts a jersey knit fabric zone, it should be noted that the depiction of a jersey knit fabric zone is only exemplary and that the implementations described herein are not limited to jersey knit fabrics. Any suitable knit stitch and density of stitch can be used to construct the metal alloy knit fabrics described herein. For example, any combination of knit stitches, such as, jersey, interlock, rib-forming stitches, or otherwise may be used.

In one implementation, the metal alloy knit fabric 1200 has between 3 and 10 wales per centimeter and between 3 and 10 courses per centimeter.

In some implementations, the metal alloy wire 1210 may comprise continuous strands of nickel-chromium based alloys, such as alloys comprising more than 12% by weight of chromium and more than 40% by weight of nickel (e.g., Inconel® alloys, Inconel® alloy 718), nickel-chromium-molybdenum based alloys, such as alloys comprising at least 10% by weight of molybdenum and more than 20% by weight of chromium (e.g., Hastelloy® alloy), aluminum, stainless steel, such as a low carbon stainless steel, for example, SS316L, which has high corrosion resistance properties. In some implementations, the metal alloy wire 1210 is constructed of a nickel-chromium superalloy. In some implementations, the metal alloy wire 1210 is heat treat hardenable. In some implementations, the metal alloy wire 1210 is constructed of a material having a Rockwell C Hardness of up to 47 RC (e.g., between 42-47 RC).

In some implementations, the metal alloy wire 1210 has a diameter up to about 0.007 inches (approximately 0.1778 millimeters). In some implementations, the metal alloy wire 1210 has a diameter from about 0.003 inches (approximately 0.0762 millimeters) to about 0.007 inches (approximately 0.1778 millimeters). However, it should be understood that the diameter of the metal alloy wire that can be knit is dependent upon the gauge of the knitting machine and as a result, different knitting machines can knit materials of different diameters.

Figure 13:
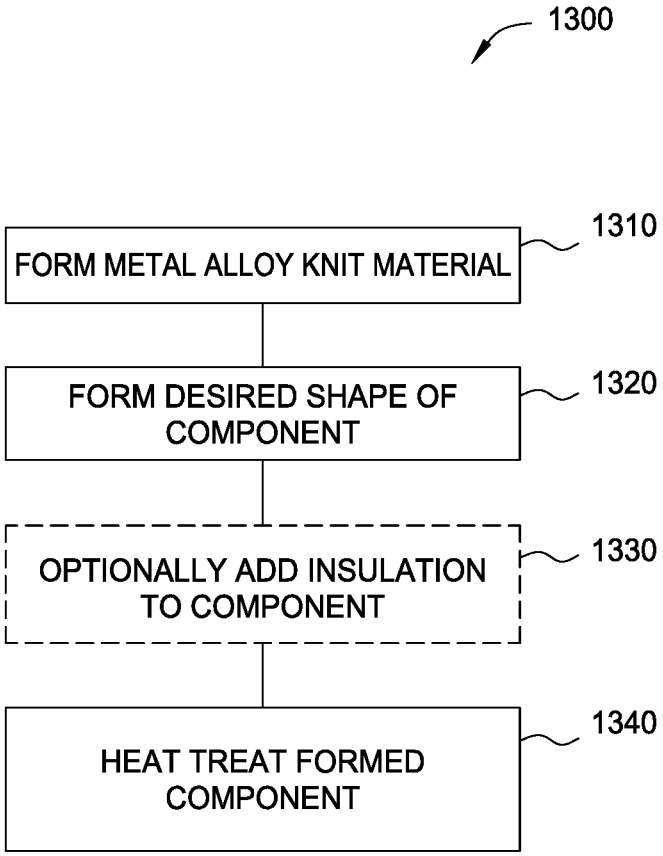
FIG. 13 is a process flow diagram for forming a thermal sealing member according to implementations described herein.

FIG. 13 is a process flow diagram 1300 for forming a component including the metal alloy knit fabric according to implementations described herein. At operation 1310, the metal alloy knit fabric is formed. In some implementations, a metal alloy wire is knit to form the metal alloy knit fabric. The metal alloy wire may be as described herein. The metal alloy knit fabric may be knit on a flat-knitting machine, a tubular-knitting machine, or any other suitable knitting machine. The metal alloy wire may be knit in a soft-tempered state, which is later hardened by a heat hardening process. The metal alloy wire may be may be fed into a knitting machine through a single material feeder to form a metal alloy knit fabric. Although knitting may be performed by hand, the commercial manufacture of knit components is generally performed by knitting machines. Any suitable knitting machine may be used. The knitting machine may be a single double-flatbed knitting machine.

In some implementations where a tubular-knitting technique is used, one or more alloy wires can be floated across opposing needle beds, which can provide additional stiffness, support after the component is expanded to shape, and heat hardened.

At operation 1320, the metal alloy knit fabric is formed into the desired shape of the final component. The desired shape is typically formed while the metal alloy wire is in a soft formable state. The metal alloy knit fabric can be laid up into a preform or fit on a mandrel to form the desired shape of the final component.

At operation 1330, the insulation material is optionally added to the interior of the formed component. Any insulation material capable of withstanding desired temperatures may be used. Exemplary insulation materials include fiberglass and ceramics. Alternatively, other widely available high temperature materials such as zirconia, alumina, aluminum silicate, aluminum oxide, and high temperature glass fibers may be employed. In some implementations, the insulation material is stitched to the metal alloy knit fabric. The insulation material may be added at any time during formation of the component. For example, the insulation material may be added prior to shaping the metal alloy knit fabric into the component or after the metal alloy knit fabric is shaped into the final component. In some implementations, where the metal alloy knit fabric is formed using a tubular-knitting process, the insulation may be inserted into the tube during knit fabrication.

In some implementations, the metal alloy knit fabric is stitched together to form the final component. The metal alloy knit fabric is typically stitched together to form the final component while the metal alloy wire is in a soft formable state. However, in some implementations, the knit fabric may be stitched together after the metal alloy wire is hardened.

At operation 1340, the formed component is heat treated to heat harden the metal alloy wire to standard specifications. In some implementations, the metal alloy knit fabric is exposed to a strengthening heat treatment process. It should be understood that the temperatures used for the strengthening heat treatment process are material dependent.

The metal alloy knit fabric may be impregnated with a selected settable impregnate which is then set. The metal alloy knit fabric may be laid up into a preform or fit into a mandrel prior to impregnation with the selected settable impregnate. Suitable settable impregnates include any settable impregnate that is compatible with the metal alloy knit fabric. Exemplary suitable settable impregnates include organic or inorganic plastics and other settable moldable substances, including glass, organic polymers, natural and synthetic rubbers and resins. The metal alloy knit fabric may be infused with the settable impregnate using any suitable liquid-molding process known in the art. The infused metal alloy knit fabric may then be cured with the application of heat and/or pressure to harden the metal alloy knit fabric into the final molded product.

One or more filler materials may also be incorporated into the metal alloy knit fabric depending upon the desired properties of the final knit product. The one or more filler materials may be fluid resistant. The one or more filler materials may be heat resistant. Exemplary filler material include common filler particles such as carbon black, mica, clays such as e.g., montmorillonite clays, silicates, glass fiber, carbon fiber, and the like, and combinations thereof.

The metal alloy knit fabrics described herein may be knit into multiple layers. Knitting the metal alloy knit fabrics described herein into multiple layers allows for combination with fabrics having different properties (e.g., structural, thermal or electric) while maintaining peripheral connectivity or registration within/between the layers of the overall fabric. The multiple layers may have intermittent stitch or inlaid connectivity between the layers. This intermittent stitch or inlaid connectivity between the layers may allow for the tailoring of functional properties/connectivity over shorter length scales (e.g., <0.25"). For example, with two knit outer layers with an interconnecting layer between the two outer layers. The multiple layers may contain pockets or channels. The pockets or channels may contain electrical wiring, sensors or other electrical functionality. The pockets or channels may contain one or more filler materials.

The one or more filler materials may be selected to enhance the desired properties of the final knit product. The one or more filler materials may be fluid resistant. The one or more filler materials may be heat resistant. Exemplary filler material include common filler particles such as carbon black, mica, clays such as e.g., montmorillonite clays, silicates, glass fiber, carbon fiber, and the like, and combinations thereof.

Fabrication and qualification tests performed on p-type bulb seal samples based on the implementations described herein demonstrated increased performance over current baselines, including durability and compression set tests. Testing was performed on (a) an integrated Nextel™ 312 ceramic fiber and Inconel® alloy 718 seal with a metal alloy knit layer overwrap (e.g., Inconel® alloy 718) formed according to implementations described herein; (b) an integrated Nextel™ 312 ceramic fiber and Inconel® alloy 718 seal without an overwrap; and (c) a multilayer current state of the art thermal barrier seals having a stainless steel mesh outer wrap. All of the p-type bulb test seals had similar Saffil insulation density.

Compression set testing was performed at 1,000 degrees Fahrenheit for 168 hours while compressed to 30%. In this high temperature compression test, all samples had less than 12% compression set post-test. Under the same compression set testing conditions, the current state of the art thermal barrier seal (c) became plastically compressed with approximately 11% compression set which can potentially result in gaps and ultimately failure as a thermal and flame barrier under operational conditions. The integrated Nextel™ 312 ceramic fiber and Inconel® alloy 718 seal without an overwrap (b) became plastically compressed with approximately 4.2% compression set. The integrated Nextel™ 312 ceramic fiber and Inconel® alloy 718 seal with a metal alloy knit layer overwrap (e.g., Inconel® alloy 718) formed according to implementations described herein (a) became plastically compressed with approximately 3.4% compression set.

A nacelle vibration profile was run on samples of the thermal barrier seals having an abrasion resistant overwrap according to implementations described herein. The nacelle vibration profile represents the take-off and landing vibrations that the thermal barrier seal is exposed to over the seal's lifespan, which is generally equivalent to thirty years of take-off and landing vibrations. The hybrid thermal barrier seals survived the complete 5 hour nacelle vibration profile when compressed to 30% and held in contact with titanium and stainless steel wear plates. The same profile, compression and wear interfaces were run on the current state of the art thermal barrier seals with failures occurring 2.5 to 3 hours into the run.

It should be noted that the products constructed with the implementations described herein are suitable for use in a variety of applications, regardless of the sizes and lengths required. For example, the implementations described herein could be used in automotive, marine, industrial, aeronautical or aerospace applications, or any other application wherein knit products are desired to protect nearby components from exposure to thermal conditions.

Figure 14:
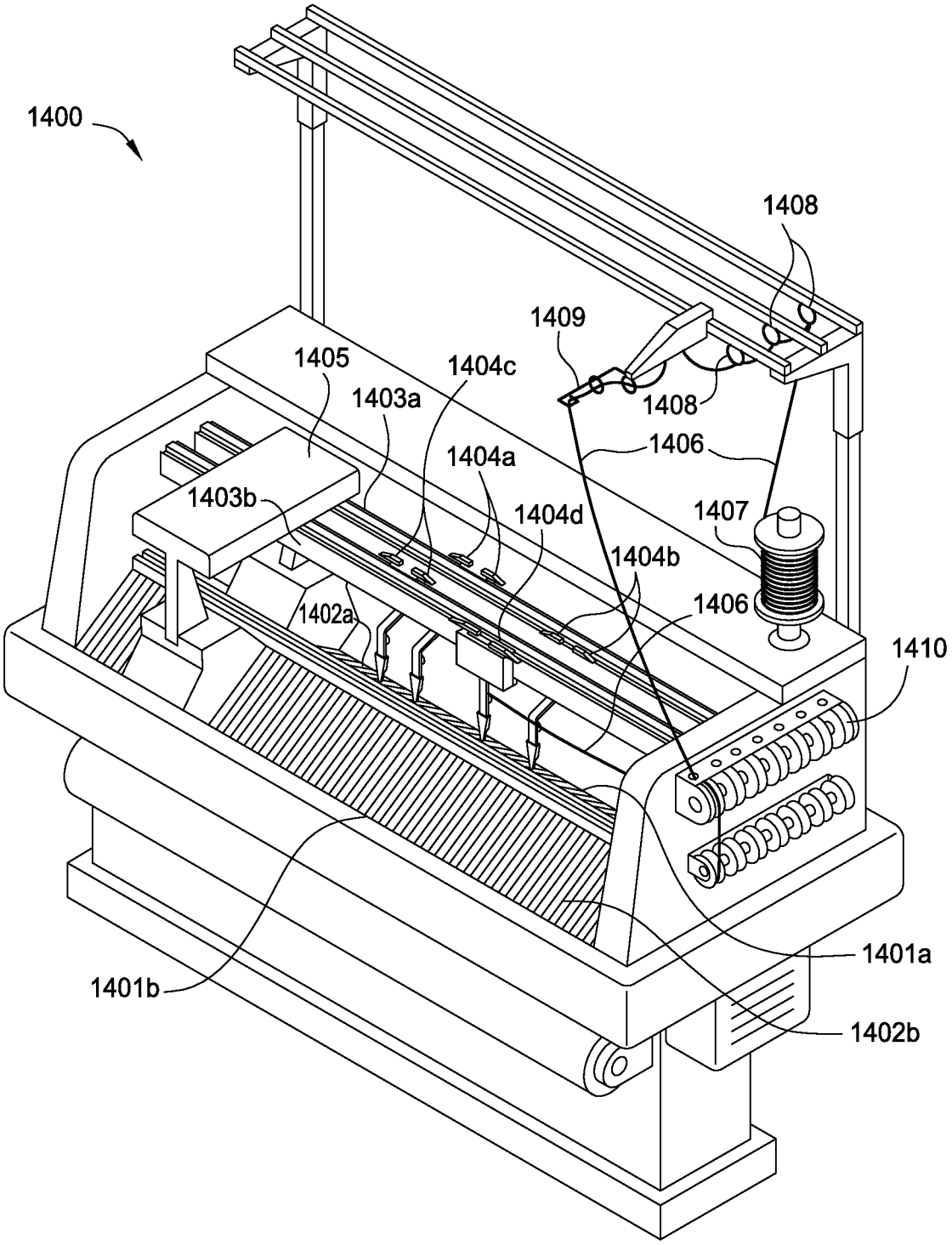
FIG. 14 is a perspective view of an exemplary knitting machine that may be used according to implementations described herein.

FIG. 14 is a perspective view of an exemplary knitting machine that may be used to knit the metal alloy knit fabric according to implementations described herein. Although knitting may be performed by hand, the commercial manufacture of knit components is generally performed by knitting machines. The knitting machine may be a single double-flatbed knitting machine. An example of a knitting machine 1400 that is suitable for producing any of the knit components described herein is depicted in FIG. 14. Knitting machine 1400 has a configuration of a V-bed flat knitting machine for purposes of example, but any of the knit components or aspects of the knit components described herein may be produced on other types of knitting machines.

Knitting machine 1400 includes two needle beds 1401*a*, 1401*b* (collectively 1401) that are angled with respect to each other, thereby forming a V-bed. Each of needle beds 1401*a*, 1401*b* include a plurality of individual needles 1402*a*, 1402*b* (collectively 1402) that lay on a common plane. That is, needles 1402*a* from one needle bed 1401*a* lay on a first plane, and needles 1402*b* from the other needle bed 1401*b* lay on a second plane. The first plane and the second plane (i.e., the two needle beds 1401) are angled relative to each other and meet to form an intersection that extends along a majority of a width of knitting machine 1400. Needles 1402 each have a first position where they are retracted and a second position where they are extended. In the first position, needles 1402 are spaced from the intersection where the first plane and the second plane meet. In the second position, however, needles 1402 pass through the intersection where the first plane and the second plane meet.

A pair of rails 1403*a*, 1403*b* (collectively 1403) extends above and parallel to the intersection of needle beds 1401 and provide attachment points for multiple standard feeders 1404*a*-1404*d* (collectively 1404). Each rail 1403 has two sides, each of which accommodates one standard feeder 1404. As such, knitting machine 1400 may include a total of four feeders 1404*a*-1404*d*. As depicted, the forward-most rail 1403*b* includes two standard feeders 1404*c*, 1404*d* on opposite sides, and the rearward-most rail 1403*a* includes two standard feeders 1404*a*, 1404*b* on opposite sides. Although two rails 1403*a*, 1403*b* are depicted, further configurations of knitting machine 1400 may incorporate additional rails 1403 to provide attachment points for more feeders 1404.

Due to the action of a carriage 1405, feeders 1404 move along rails 1403 and needle beds 1401, thereby supplying metal alloy wires to needles 1402. In FIG. 14, a metal alloy wire 1406 is provided to feeder 1404*d* by a spool 1407 through various metal alloy wire guides 1408, a metal alloy wire take-back spring 1409 and a metal alloy wire tensioner 1410 before entering the feeder 1404*d* for knitting action. The metal alloy wire 1406 may be any of the alloy wires previously described herein.

While the foregoing is directed to implementations of the present disclosure, other and further implementations of the disclosure may be devised without departing from the basic scope thereof, and the scope thereof is determined by the claims that follow.

What is claimed is:

1. A method of forming a thermal sealing member, comprising:

combining an intermediate wrap member with an outer abrasion resistant wrap member, wherein the intermediate wrap member comprises one or more layers of a ceramic-based fiber material;

wherein the ceramic-based fiber material is a ceramic-based knit fabric, comprising:

a continuous ceramic strand; and a continuous load-relieving process aid strand, wherein the continuous ceramic strand is served around the continuous load-relieving process aid strand;

wherein the outer abrasion resistant wrap member comprises one or more layers of a single-layer metal alloy knit fabric formed by knit loops of a first metal alloy wire; and wherein the single-layer metal alloy knit fabric can withstand temperatures greater than or equal to 1,000 degrees Fahrenheit (538 degrees Celsius).

2. The method of claim 1, wherein the first metal alloy wire is constructed of a nickel-chromium superalloy.

3. The method of claim 1, wherein the first metal alloy wire has a diameter from about 0.003 inches (0.0762 millimeters) to about 0.007 inches (0.1778 millimeters).

4. The method of claim 1, wherein the single-layer metal alloy knit fabric has between 3 and 10 wales per centimeter and between 3 and 10 courses per centimeter.

5. The method of claim 1, wherein the single-layer metal alloy knit fabric is constructed using a flat knitting technique.

6. The method of claim 1, wherein the single-layer metal alloy knit fabric is formed into a tubular structure using a tubular knitting technique.

7. The method of claim 1, wherein the first metal alloy wire is knit in a soft-tempered state.

8. The method of claim 7, wherein the first metal alloy wire is heat hardened after a final shape of the single-layer metal alloy knit fabric is achieved.

9. The method of claim 1, wherein the continuous load-relieving process aid strand comprises a second metal alloy wire constructed of a material selected from a nickel-chromium based alloy, a nickel-chromium-molybdenum based alloy, aluminum, and stainless steel.

10. The method of claim 9, wherein the continuous ceramic strand comprises one or more inorganic fibers selected from thoria-silica metal (III) oxide fibers, zirconia silica fibers, alumina-silica fibers, alumina-chromia-metal, and alumina-boria-silica fibers.

11. The method of claim 1, further comprising adding an insulation material to the intermediate wrap member.

12. The method of claim 1, further comprising adding a core member constructed of a resilient material having spring-like properties.

13. The method of claim 1, wherein the thermal sealing member is selected from an M-shaped double-blade bulb seal, an omega-shaped bulb seal, and a p-shaped bulb seal.

14. The method of claim 1, further comprising:

feeding the first metal alloy wire through a single material feeder of a knitting machine; and knitting the first metal alloy wire to form the single-layer metal alloy knit fabric.

15. A method of forming a thermal sealing member, comprising:

forming an intermediate wrap member, comprising:

simultaneously feeding a continuous ceramic strand and a continuous load-relieving process aid strand through a first material feeder and a first metal alloy wire through a second material feeder; and concurrently knitting the continuous ceramic strand, the continuous load-relieving process aid strand and the first metal alloy wire to form a single-layer ceramic-based knit fabric, wherein the first metal alloy wire is in a soft-tempered state;

forming an outer abrasion resistant wrap member, comprising:

feeding a second metal alloy wire through a single material feeder; and knitting the second metal alloy wire to form one or more layers of a single-layer metal alloy knit fabric formed by knit loops of the second metal alloy wire, wherein the single-layer metal alloy knit fabric can withstand temperatures greater than or equal to 1,000 degrees Fahrenheit (538 degrees Celsius); and combining the intermediate wrap member with the outer abrasion resistant wrap member.

16. The method of claim 15, wherein the second metal alloy wire is constructed of a nickel-chromium superalloy.

17. The method claim 16, wherein the second metal alloy wire has a diameter from about 0.003 inches (0.0762 millimeters) to about 0.007 inches (0.1778 millimeters).

18. The method of claim 15, wherein the continuous load-relieving process aid strand comprises a third metal alloy wire constructed of a material selected from a nickel-chromium based alloy, a nickel-chromium-molybdenum based alloy, aluminum, and stainless steel.

19. The method of claim 18, wherein the continuous ceramic strand comprises one or more inorganic fibers selected from thoria-silica metal (III) oxide fibers, zirconia silica fibers, alumina-silica fibers, alumina-chromia-metal, and alumina-boria-silica fibers.

20. A method of forming a thermal sealing member, comprising:

combining an intermediate wrap member with an outer abrasion resistant wrap member, wherein the intermediate wrap member comprises one or more layers of a ceramic-based fiber material;

wherein the outer abrasion resistant wrap member comprises one or more layers of a single-layer metal alloy knit fabric formed by knit loops of a first metal alloy wire;

wherein the single-layer metal alloy knit fabric can withstand temperatures greater than or equal to 1,000 degrees Fahrenheit (538 degrees Celsius);

wherein the first metal alloy wire is knit in a soft-tempered state; and wherein the first metal alloy wire is heat hardened after a final shape of the single-layer metal alloy knit fabric is achieved.

21. A method of forming a thermal sealing member, comprising:

combining an intermediate wrap member with an outer abrasion resistant wrap member, wherein the intermediate wrap member comprises one or more layers of a ceramic-based fiber material;

wherein the outer abrasion resistant wrap member comprises one or more layers of a single-layer metal alloy knit fabric formed by knit loops of a first metal alloy wire; and wherein the single-layer metal alloy knit fabric can withstand temperatures greater than or equal to 1,000 degrees Fahrenheit (538 degrees Celsius); and adding an insulation material to the intermediate wrap member.

* * * * *